US010475425B2

(12) United States Patent
Sato et al.

(10) Patent No.: US 10,475,425 B2
(45) Date of Patent: Nov. 12, 2019

(54) MUSICAL SOUND GENERATION DEVICE

(71) Applicant: CASIO COMPUTER CO., LTD., Shibuya-ku, Tokyo (JP)

(72) Inventors: Hiroki Sato, Nishi-Tokyo (JP); Hajime Kawashima, Akishima (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 15/920,975

(22) Filed: Mar. 14, 2018

(65) Prior Publication Data

US 2018/0277074 A1 Sep. 27, 2018

(30) Foreign Application Priority Data

Mar. 23, 2017 (JP) ..... 2017-058044

(51) Int. Cl.

| | |
|---|---|
| ***G10H 7/00*** | (2006.01) |
| ***G10H 1/00*** | (2006.01) |
| ***G10H 1/18*** | (2006.01) |
| ***G10H 1/24*** | (2006.01) |
| ***G10H 7/04*** | (2006.01) |
| ***G10H 1/32*** | (2006.01) |

(52) U.S. Cl.

CPC ..... *G10H 1/0008* (2013.01); *G10H 1/183* (2013.01); *G10H 1/24* (2013.01); *G10H 1/32* (2013.01); *G10H 7/045* (2013.01); *G10H 2230/031* (2013.01); *G10H 2240/161* (2013.01)

(58) Field of Classification Search

CPC ..... G10H 1/0008; G10H 1/32; G10H 7/045; G10H 1/183; G10H 1/24; G10H 2240/161; G10H 2230/031

USPC ..... 84/604

See application file for complete search history.

(56) References Cited

U.S. PATENT DOCUMENTS 4,429,367 A 1/1984 Ikeda
4,508,001 A 4/1985 Suzuki
(Continued)

FOREIGN PATENT DOCUMENTS

EP 2071560 A1 6/2009
JP 09026791 A 1/1997
(Continued)

OTHER PUBLICATIONS

Extended European Search Report (EESR) dated Jun. 7, 2018 issued in counterpart European Application No. 18161874.5.
(Continued)

*Primary Examiner* — Jeffrey Donels
(74) *Attorney, Agent, or Firm* — Holtz, Holtz & Volek PC

(57) ABSTRACT

A musical sound generation device including a first memory having a plurality of storage areas where waveform data is read out and stored, a waveform generator which functions as a plurality of waveform generating sections each of which generates a waveform for emitting a sound by reading out waveform data from a selected storage area of the first memory; and a control processor which determines, when an instruction for sound emission is provided, a combination of a waveform generating section and a storage area to be used for the instructed sound emission, based on a status of reading waveform data from each storage area by each waveform generating section.

12 Claims, 22 Drawing Sheets

< TIMBRE WAVEFORM DIRECTORY >

| TIMBRE NUMBER | WAVEFORM NUMBER | MINIMUM VELOCITY | MAXIMUM VELOCITY | SMALLEST KEY NUMBER | LARGEST KEY NUMBER | ADDRESS FROM WAVEFORM AREA START | WAVEFORM SIZE |
|---|---|---|---|---|---|---|---|
| 0 | 0(1A) | 0 | 60 | 0 | 40 | 0000000H | 00BA00H |
| 0 | 1(2A) | 61 | 127 | 0 | 40 | 0000A00H | 00C100H |
| | | | ⋮ | | | | |
| | 10(5B) | 80 | 127 | 100 | 127 | 00F2000H | 013800H |
| | | | ⋮ | | | | |
| 0 | 31 (UNASSIGNED) | 0 | 0 | 0 | 0 | 00FA000H | 000000H |
| 1 | 0 | 0 | 50 | 0 | 20 | 00FA000H | 009200H |
| | | | ⋮ | | | | |
| 15 | 31 | 70 | 7F | 60 | 7F | 98000000 | 02C500H |

(56) References Cited

U.S. PATENT DOCUMENTS

| | | | | | |
|---|---|---|---|---|---|
| 4,773,294 | A * | 9/1988 | Iizuka | G10H 1/24 | 84/477 R |
| 5,345,035 | A | 9/1994 | Yamada | | |
| 5,442,126 | A * | 8/1995 | Tokiharu | G10H 1/0033 | 84/603 |
| 5,463,183 | A * | 10/1995 | Konno | G10H 1/0575 | 84/604 |
| 5,686,682 | A * | 11/1997 | Ohshima | G10H 1/24 | 84/603 |
| 5,714,703 | A * | 2/1998 | Wachi | G10H 7/004 | 84/603 |
| 5,714,704 | A | 2/1998 | Suzuki et al. | | |
| 5,804,755 | A * | 9/1998 | Furukawa | G10H 1/08 | 84/656 |
| 6,576,827 | B2 | 6/2003 | Tamura | | |
| 7,420,115 | B2 | 9/2008 | Kawamoto et al. | | |
| 8,008,569 | B2 | 8/2011 | Iwase | | |
| 8,035,021 | B2 | 10/2011 | Shirahama et al. | | |
| 9,922,633 | B2 | 3/2018 | Sato | | |
| 2002/0134222 | A1 | 9/2002 | Tamura | | |
| 2006/0137515 | A1 | 6/2006 | Kawamoto et al. | | |
| 2009/0151543 | A1 | 6/2009 | Iwase | | |
| 2010/0236384 | A1* | 9/2010 | Shirahama | G10H 1/183 | 84/605 |
| 2011/0246188 | A1 | 10/2011 | Nakanishi | | |
| 2014/0123835 | A1* | 5/2014 | Tsuchiya | G10H 7/06 | 84/604 |
| 2015/0122110 | A1 | 5/2015 | Nagasaka | | |
| 2017/0278503 | A1* | 9/2017 | Sato | G10H 7/008 | |
| 2018/0277073 | A1* | 9/2018 | Sato | G10H 1/24 | |
| 2019/0034115 | A1 | 1/2019 | Sato et al. | | |

FOREIGN PATENT DOCUMENTS

| | | | |
|---|---|---|---|
| JP | 09319373 | A | 12/1997 |
| JP | 11007281 | A | 1/1999 |
| JP | 2000276172 | A | 10/2000 |
| JP | 2007047293 | A | 2/2007 |
| JP | 2008015315 | A | 1/2008 |
| JP | 2008249756 | A | 10/2008 |
| JP | 2017054076 | A | 3/2017 |

OTHER PUBLICATIONS

Related U.S. Appl. No. 15/910,901, Title: "Musical Sound Generation Device," filed Mar. 2, 2018, First Named Inventor: Hiroki Sato. Notice of Allowance dated Apr. 3, 2019 issued in U.S. Appl. No. 15/910,901.

* cited by examiner

< TIMBRE WAVEFORM (VELOCITY KEY AREA WAVEFORM) SPLIT >

< TIMBRE WAVEFORM DIRECTORY >

| TIMBRE NUMBER | WAVEFORM NUMBER | MINIMUM VELOCITY | MAXIMUM VELOCITY | SMALLEST KEY NUMBER | LARGEST KEY NUMBER | ADDRESS FROM WAVEFORM AREA START | WAVEFORM SIZE |
|---|---|---|---|---|---|---|---|
| 0 | 0(1A) | 0 | 60 | 0 | 40 | 0000000H | 00BA00H |
| 0 | 1(2A) | 61 | 127 | 0 | 40 | 0000A00H | 00C100H |
| | | | | ⋮ | | | |
| | 10(5B) | 80 | 127 | 100 | 127 | 00F2000H | 013800H |
| | | | | ⋮ | | | |
| 0 | 31 (UNASSIGNED) | 0 | 0 | 0 | 0 | 00FA000H | 000000H |
| 1 | 0 | 0 | 50 | 0 | 20 | 00FA000H | 009200H |
| | | | | ⋮ | | | |
| 15 | 31 | 70 | 7F | 60 | 7F | 98000000 | 02C500H |

FIG. 6A

< STATIC WAVEFORM DIRECTORY >

| AREA | TIMBRE NUMBER | TIMBRE WAVEFORM NUMBER | START ADDRESS | WAVEFORM SIZE |
|---|---|---|---|---|
| STATIC WAVEFORM 1 | 0 | 4 | 00000000H | 18522H |
| STATIC WAVEFORM 2 | 0 | 8 | 00018522H | 122ACH |
| ⋮ | | | | |
| STATIC WAVEFORM N | 15 | 30 | 00AC122AH | 38A6EH |

FIG. 6B

< WAVEFORM READING DEVICE BUFFER DIRECTORY >

| BUFFER NUMBER | LINK FLAG | LINK BUFFER NUMBER | TRANSFER FLAG | ACCESSING COUNT | TIMBRE NUMBER | TIMBRE WAVEFORM NUMBER | WAVEFORM SIZE |
|---|---|---|---|---|---|---|---|
| 1 | 0 | 0 | 1 | 0 | 0 | 8 | 8C50H |
| 2 | 1 | 4 | 1 | 2 | 0 | 12 | 8908H |
| 3 | 0 | 0 | 1 | 1 | 0 | 10 | 6384H |
| 4 | 0 | 0 | 1 | 0 | 0 | 11 | 7890H |
| 5 | 1 | 2 | 0 | 0 | 0 | 0 | 0 |
| ⋮ | | | | | | | |
| 256 | 0 | 0 | 0 | 0 | 0 | 0 | 0 |

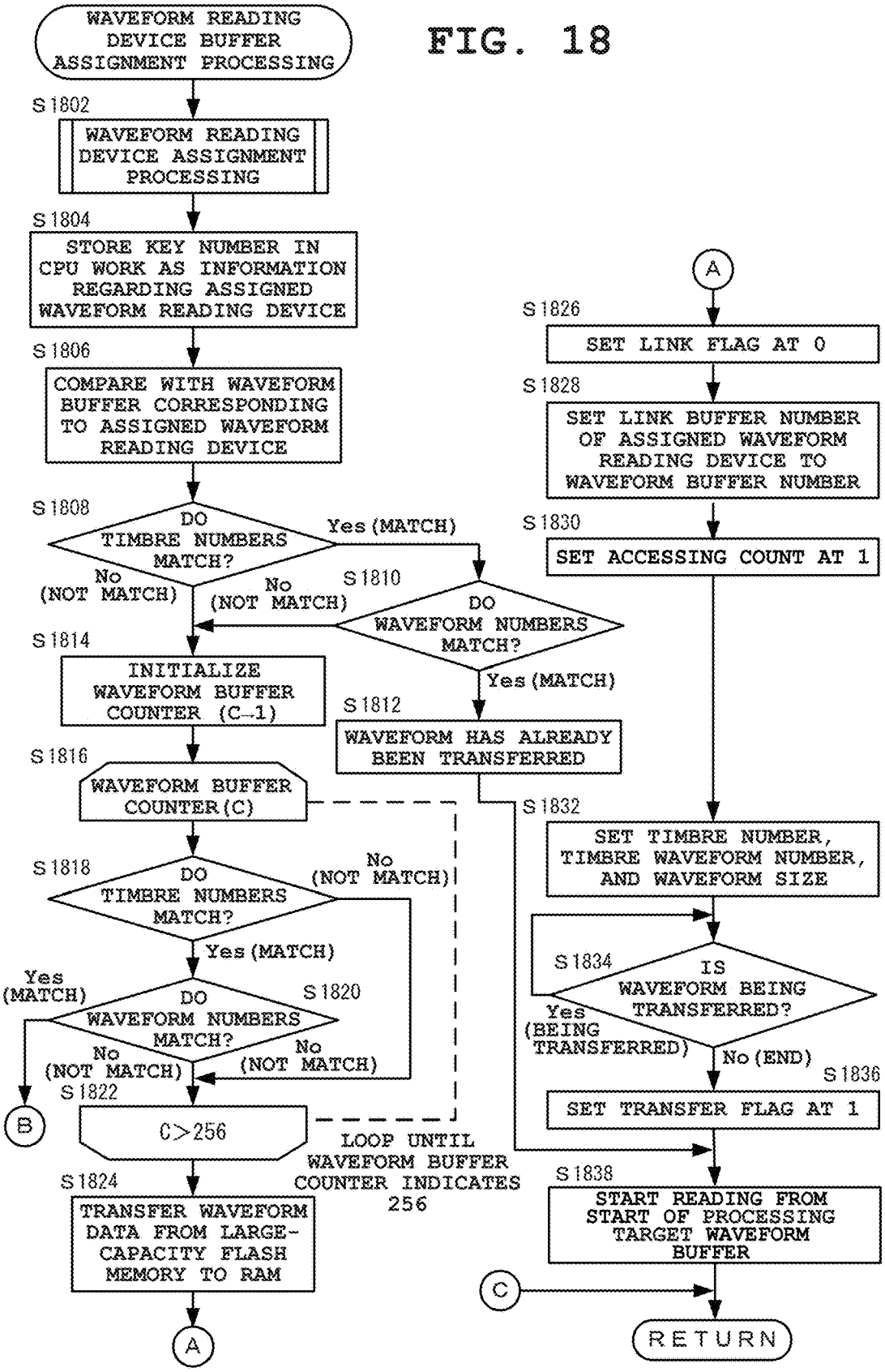
FIG. 18
WAVEFORM READING DEVICE BUFFER ASSIGNMENT PROCESSING
S1802
WAVEFORM READING DEVICE ASSIGNMENT PROCESSING
S1804
STORE KEY NUMBER IN CPU WORK AS INFORMATION REGARDING ASSIGNED WAVEFORM READING DEVICE
S1806
COMPARE WITH WAVEFORM BUFFER CORRESPONDING TO ASSIGNED WAVEFORM READING DEVICE
S1808
DO TIMBRE NUMBERS MATCH?
Yes (MATCH)
No (NOT MATCH)
S1810
DO WAVEFORM NUMBERS MATCH?
No (NOT MATCH)
Yes (MATCH)
S1812
WAVEFORM HAS ALREADY BEEN TRANSFERRED
S1814
INITIALIZE WAVEFORM BUFFER COUNTER (C←1)
S1816
WAVEFORM BUFFER COUNTER (C)
S1818
DO TIMBRE NUMBERS MATCH?
No (NOT MATCH)
Yes (MATCH)
S1820
DO WAVEFORM NUMBERS MATCH?
Yes (MATCH)
No (NOT MATCH)
No (NOT MATCH)
S1822
C>256
LOOP UNTIL WAVEFORM BUFFER COUNTER INDICATES 256
B
S1824
TRANSFER WAVEFORM DATA FROM LARGE-CAPACITY FLASH MEMORY TO RAM
A
A
S1826
SET LINK FLAG AT 0
S1828
SET LINK BUFFER NUMBER OF ASSIGNED WAVEFORM READING DEVICE TO WAVEFORM BUFFER NUMBER
S1830
SET ACCESSING COUNT AT 1
S1832
SET TIMBRE NUMBER, TIMBRE WAVEFORM NUMBER, AND WAVEFORM SIZE
S1834
IS WAVEFORM BEING TRANSFERRED?
Yes (BEING TRANSFERRED)
No (END)
S1836
SET TRANSFER FLAG AT 1
S1838
START READING FROM START OF PROCESSING TARGET WAVEFORM BUFFER
C
RETURN

MUSICAL SOUND GENERATION DEVICE

CROSS-REFERENCE TO RELATED APPLICATION

This application is based upon and claims the benefit of priority from the prior Japanese Patent Application No. 2017-058044, filed Mar. 23, 2017, the entire contents of which are incorporated herein by reference.

BACKGROUND OF THE INVENTION

1. Field of the Invention

The present invention relates to a musical sound generation device, a musical sound generation method, a musical sound generation program and an electronic instrument.

2. Description of the Related Art

In electronic instruments and personal computers in recent years, musical sound generation methods using various sound source data (waveform data) have been adopted so as to actualize musical sounds having a higher degree of fidelity to the original sounds of wind instruments, stringed instruments, and the like. For example, in order to achieve a configuration where more pieces of waveform data of a longer time can be used, some software sound source that is operated on an electronic instrument or personal computer adopts a system in which waveform data not for use is stored in a (low-speed, large-capacity) storage device with a low access speed and a large storage capacity such as a flash memory or hard disk, and only waveform data for use is transferred to a (high-speed, small-capacity) storage device with a high access speed and a small storage capacity which is directly accessible from a sound source device, and read out in accordance with a musical performance for sound emission.

Here, generally speaking, high-speed, small-capacity storage devices have high product prices, and low-speed, large-capacity storage devices have low product prices. For this reason, waveform data having a data size larger than the storage capacity of a high-speed, small-capacity storage device is retained in a low-speed, large-capacity storage device, and is moved to the high-speed, small-capacity storage device only when needed for use in sound emission, whereby both of a favorable waveform data reading operation and a reduction in production cost are achieved. An example of a sound source device adopting this system is described in Japanese Patent Application Laid-Open (Kokai) Publication No. 11-007281, in which a musical sound with a desired timbre is emitted by pieces of waveform data read out being synthesized.

SUMMARY OF THE INVENTION

In accordance with one aspect of the present invention, there is provided a musical sound generation device comprising: a first memory having a plurality of storage areas where waveform data is read out and stored; a waveform generator which functions as a plurality of waveform generating sections each of which generates a waveform for emitting a sound by reading out waveform data from a selected storage area of the first memory; and a control processor which determines, when an instruction for sound emission is provided, a combination of a waveform generating section and a storage area to be used for the instructed sound emission, based on a status of reading waveform data from each storage area by each waveform generating section.

In accordance with another aspect of the present invention, there is provided a musical sound generation method, wherein a waveform generator of a musical sound generation device performs control as a plurality of waveform generating sections each of which generates a waveform for emitting a sound by reading out waveform data from a selected storage area in a first memory having a plurality of storage areas that read out and store waveform data, and wherein a control processor of the musical sound generation device determines, when an instruction for sound emission is provided, a combination of a waveform generating section and a storage area to be used for the instructed sound emission, based on a status of reading waveform data from each storage area by each waveform generating section.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

BRIEF DESCRIPTION OF THE DRAWINGS

FIG. 6A and FIG. 6B are diagrams for describing a static waveform area and a dynamic waveform area of the RAM applied in the present embodiment;

FIG. 18 is a first flowchart of waveform reading device buffer assignment processing applied in the note-on processing of the electronic keyboard instrument control method according to the present embodiment;

DETAILED DESCRIPTION OF THE PREFERRED EMBODIMENTS

Embodiments for implementing a musical sound generation device, a musical sound generation method, a musical sound generation program and an electronic instrument according to the present invention will hereinafter be described in detail with reference to the drawings.

<Electronic Instrument>

Figure 1:
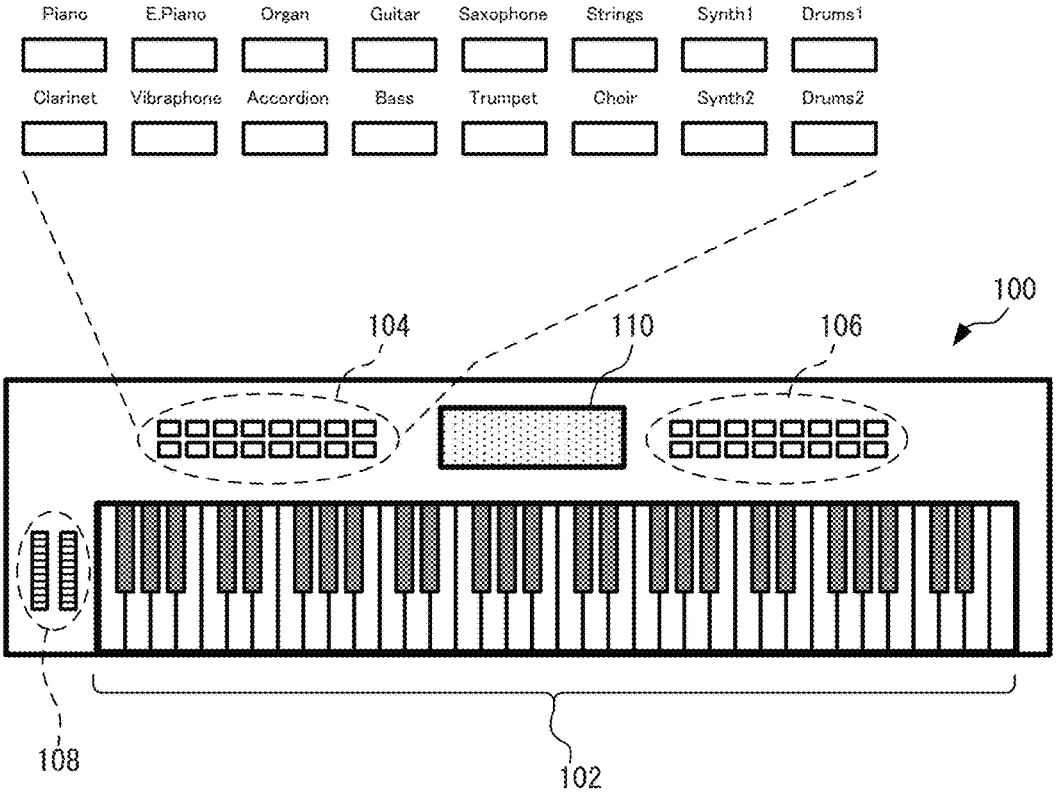
FIG. 1 is an external view of an embodiment of an electronic instrument where a musical sound generation device according to the present invention has been applied.

FIG. 1 is an external view of an embodiment of an electronic instrument where a musical sound generation device according to the present invention has been applied. Here, an electronic keyboard instrument of a waveform reading type is taken as an embodiment of the electronic instrument according to the present invention for description.

An electronic keyboard instrument 100 according to the present embodiment includes, on one surface side of its instrument main body, a keyboard (input section) 102 constituted by a plurality of keys that serve as musical performance operators, a switch panel constituted by timbre selection buttons (input section) 104 that serve as waveform selection operators for timbre selection and function selection buttons 106 for selection of various functions other than timbres, a bender/modulation wheel 108 for providing various modulations (musical performance effects) such as pitch bend, tremolo, and vibrato, and a display section such as an LCD (Liquid Crystal Display) 110 for displaying a timbre and other various setting information, as shown in FIG. 1. Although omitted in the drawing, the electronic keyboard instrument 100 includes a speaker (output section) for outputting musical sounds generated by a musical performance, on a bottom surface portion, side surface portion, back surface portion, or the like of the instrument main body.

In the above-structured electronic keyboard instrument 100, the timbre selection buttons 104 serve as waveform selection operators for selecting one of various timbre categories such as piano ("Piano" in the drawing), electric piano ("E. Piano" in the drawing), organ ("Organ" in the drawing), guitar ("Guitar" in the drawing), saxophone ("Saxophone" in the drawing), strings ("Strings" in the drawing), synthesizers ("Synth1" and "Synth2" in the drawing), and drums ("Drums1" and "Drums2" in the drawing) as shown in FIG. 1. In FIG. 1, sixteen timbre categories are shown. By depressing one of the timbre selection buttons 104, an instrument player (user) of the electronic keyboard instrument 100 can select and play any timbre category from among the above-described sixteen timbre categories.

Figure 2:
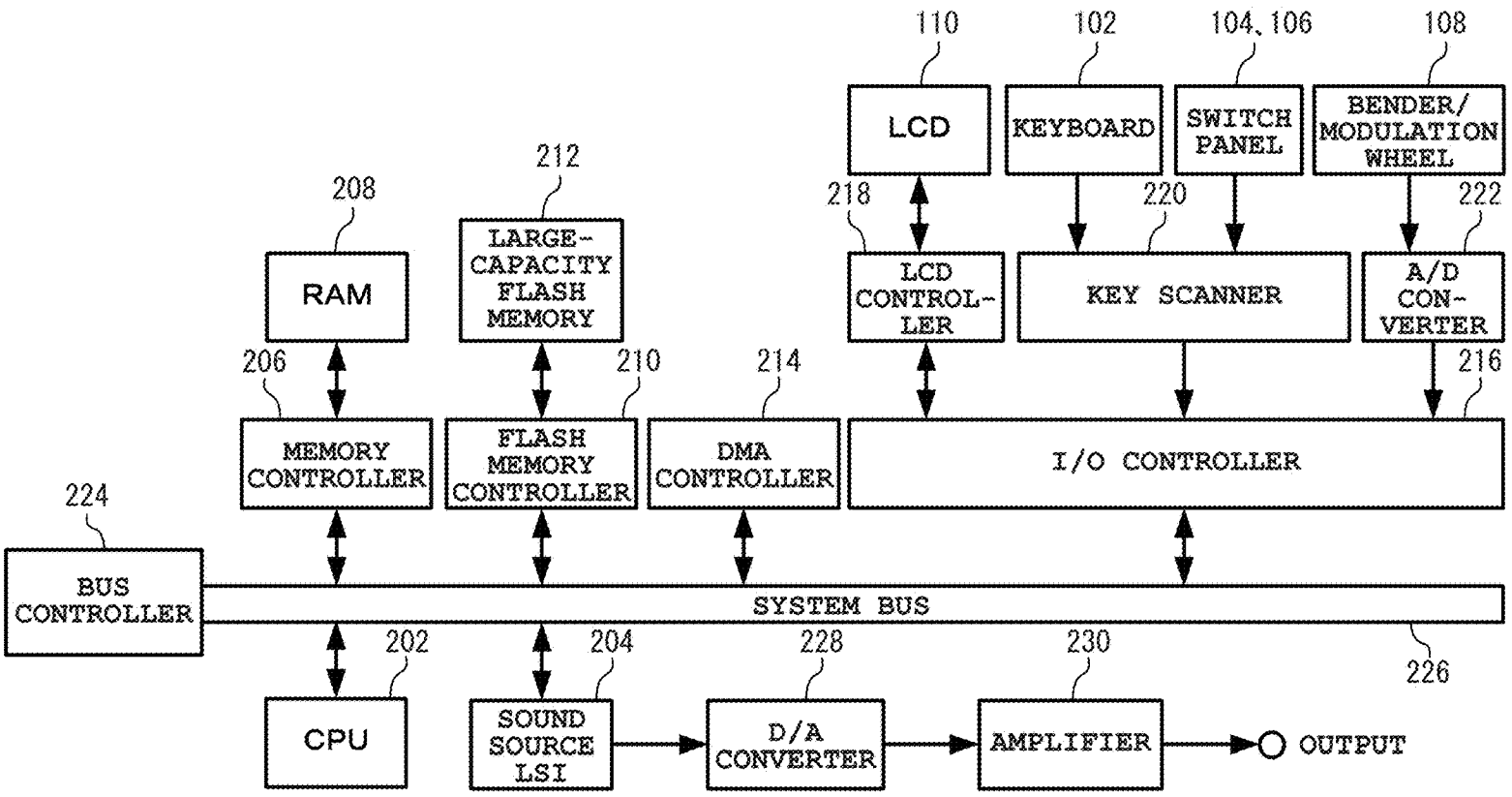
FIG. 2 is a block diagram showing an example of the hardware structure of the electronic keyboard instrument according to the present embodiment.
Figure 3:
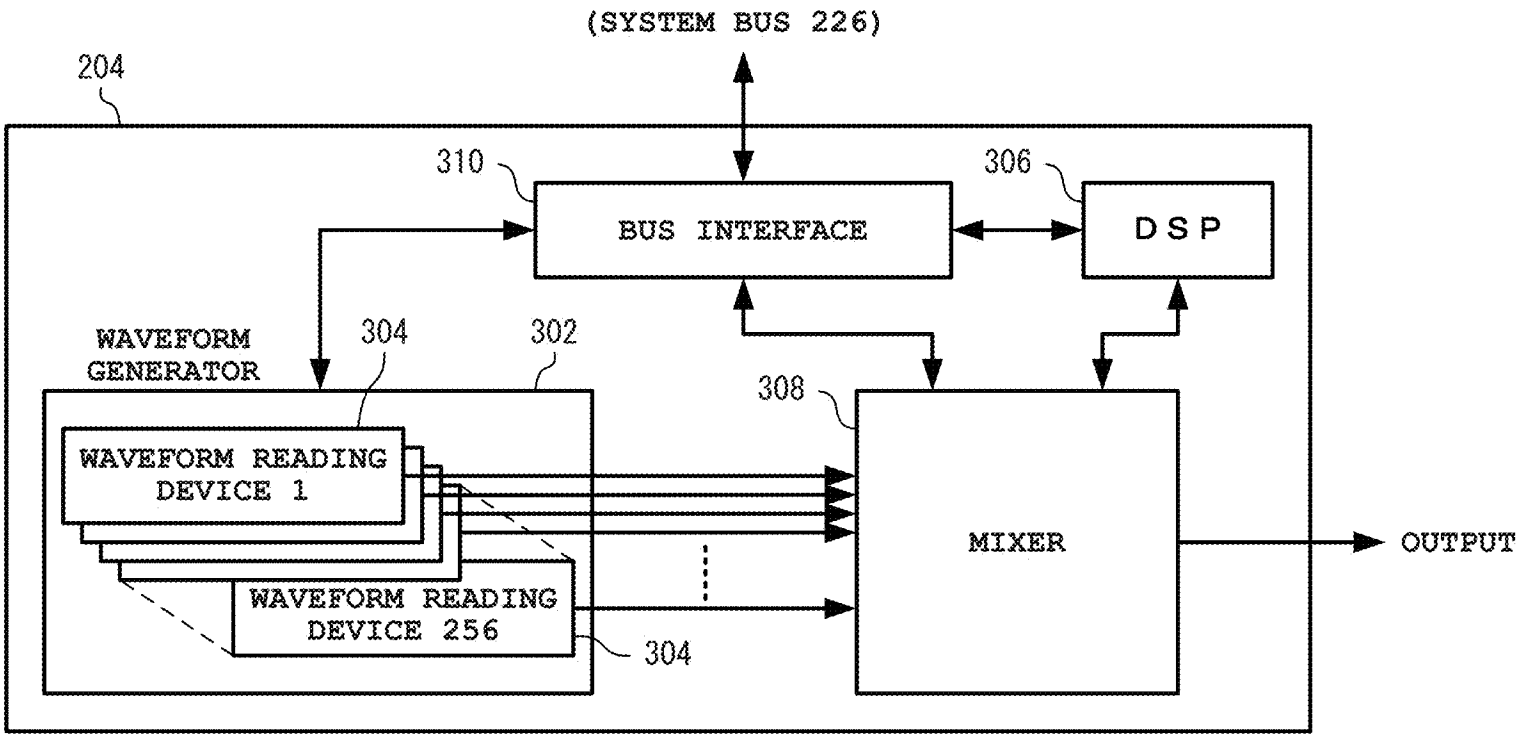
FIG. 3 is a block diagram showing an example of the internal structure of a sound source LSI applied in the present embodiment.

FIG. 2 is a block diagram showing an example of the hardware structure of the electronic keyboard instrument according to the present embodiment. FIG. 3 is a block diagram showing an example of the internal structure of a sound source LSI applied in the present embodiment.

The electronic keyboard instrument 100 is structured to include, for example, a CPU (Central Processing Unit) 202, a sound source LSI (Large Scale Integration) 204, a DMA (Direct Memory Access) controller 214, and an I/O (input/output) controller 216, which are each directly connected to a system bus 226, as shown in FIG. 2. Also, the electronic keyboard instrument 100 is structured to include a small-capacity (second storage capacity) RAM (Random Access Memory) 208 with a high access speed (second reading speed) connected to the system bus 226 via a memory controller 206 and a large-capacity (first storage capacity) flash memory 212 with a low access speed (first read speed) connected thereto via a flash memory controller 210. Also, the electronic keyboard instrument 100 is structured to include the LCD 110 of FIG. 1 connected to the I/O controller 216 via an LCD controller 218, the keyboard 102 and the switch panel constituted by the timbre selection buttons 104 and the function selection buttons 106 of FIG. 1 which have been connected thereto via a key scanner 220, and the bender/modulation wheel 108 of FIG. 1 connected thereto via an A/D converter (analog-digital conversion circuit) 222. These sections are connected to the system bus 226 via the I/O controller 216. Also, the system bus 226 is connected to a bus controller 224, and signals and data transmitted and received among the above-described sections via the system bus 226 are controlled by the bus controller 224. Also, to the sound source LSI 204 (sound source processor), a D/A converter (digital-analog conversion circuit) 228 and an amplifier 230 are connected. Digital musical sound waveform data outputted from the sound source LSI 204 is converted by the D/A converter 228 to an analog musical sound waveform signal, amplified by the amplifier 230, and then outputted from an output terminal or the speaker omitted in the drawing. Here, at least the CPU (control section) 202, the sound source LSI (sound emitting section) 204, the RAM (second storage section) 208, and the large-capacity flash memory (first storage section) 212 constitute a musical sound generation device according to the present invention.

As described above, the entire electronic keyboard instrument 100 is structured with the system bus 226 that is controlled by the bus controller 224 as a centerpiece. Specifically, the bus controller 224 controls priorities of signals and data at the time of transmission and reception in each of the above-described sections connected to the system bus 226. For example, although the RAM 208 is structured to be shared by the CPU 202 and the sound source LSI 204 in the electronic keyboard instrument 100, since a data loss is not allowed in the sound source LSI 204, the highest priority is set by the bus controller 224 to transmission and reception between the sound source LSI 204 and the RAM 208, and an access to the RAM 208 by the CPU 202 is limited as required.

In the above-described structure, the CPU 202 is a main processor (control processor) that performs processing in the entire device, and performs a control operation on the electronic keyboard instrument 100 by executing a predetermined control program while using the RAM 208 as a work area.

The RAM 208 is a memory device whose access speed is generally high, capacity is low, and product price is high as compared to the large-capacity flash memory 212 described below, and is connected to the system bus 226 via the memory controller 206 serving as an interface. The RAM 208 has stored therein waveform data, a control program, various fixed data, and the like transferred from the large-capacity flash memory 212. In particular, the RAM 208 has a function to serve as a sound source memory (or a waveform memory) which develops waveform data for use in musical sound generation processing that is performed in the sound source LSI 204 described below, and the waveform data of a musical sound to be emitted is always arranged in the RAM 208. In addition, the RAM 208 is also used as a work area for the CPU 202 and a DSP (digital signal processing circuit) 306 incorporated in the sound source LSI 204.

Here, the storage capacity of the RAM 208 is smaller than that of the large-capacity flash memory 212, and therefore storage contents in the RAM 208 are replaced one after another. However, waveform data satisfying a predetermined condition (having a data size exceeding a threshold value described further below) is fixedly stored in the RAM 208 with it being unchanged by waveform data transfer during a musical performance. Furthermore, as for waveform data satisfying another predetermined condition (having a data size equal to or smaller than the threshold value and having been already transferred to the RAM 208 as described further below), waveform data stored in the RAM 208 is used. As such, the present embodiment is characterized by a method of managing waveform data stored in the RAM 208.

The large-capacity flash memory 212 is, in general, a large-capacity memory device with a low product price and a low access speed such as that of an NAND type, and is connected to the system bus 226 via the flash memory controller 210 serving as an interface. The large-capacity flash memory 212 has stored therein various fixed data such as waveform data of all timbres, parameter data of all timbres, program data of control programs to be executed in the CPU 202 and the DSP 306 of the sound source LSI 204, music data, and data set by the instrument player, which will be used (or can be used) in musical sound generation processing in the sound source LSI 204. Here, all pieces of waveform data stored in the large-capacity flash memory 212 are compressed with, for example, one word length being set at eight bits. The waveform data and the like stored in the large-capacity flash memory 212 are read out by being sequentially accessed from the CPU 202 and transferred to the RAM 208.

In the present embodiment, the structure has been described in which an NAND-type flash memory (in practice, an SSD (Solid State Drive) structured by integrating a flash memory) is used as a large-capacity and inexpensive memory device. However, the present invention is not limited thereto. For example, as this large-capacity and inexpensive memory device, a hard disk (HDD) may be adopted. Also, the flash memory and the hard disk herein may be structured to be attachable to and detachable from (that is, replaceable in) the electronic keyboard instrument 100. Also, if high-speed data transfer is possible, a hard disk on a specific network or the Internet (that is, on a cloud) may be adopted as this large-capacity and inexpensive memory device.

The LCD controller 218 is an IC (Integrated Circuit) which controls the display status of the LCD 110. The key scanner 220 is an IC which scans the status of the keyboard 102 and the switch panel such as the timbre selection buttons 104 and the function selection buttons 106, and notifies the CPU 202 of the status. The A/D converter 222 is an IC which detects the operation position of the bender/modulation wheel 108. The LCD controller 218, the key scanner 220, and the A/D converter 222 input and output data and signals to and from the system bus 226 via the I/O controller 216 serving as an interface.

The sound source LSI 204 is a dedicated IC which performs musical sound generation processing described below. The above-described large-capacity flash memory 212 cannot be randomly accessed from the CPU 202 or the sound source LSI 204. For this reason, data and the like stored in the large-capacity flash memory 212 are once transferred to the randomly-accessible RAM 208. The sound source LSI 204 reads out, based on an instruction from the CPU 202, waveform data transferred to the RAM 208 from a target timbre storage area at a speed corresponding to a pitch specified by a musical performance, provides the read waveform data with an amplification envelope of a velocity specified by the musical performance, and outputs the resultant waveform data as output musical sound waveform data.

The sound source LSI 204 includes, for example, a waveform generator 302 having 256 waveform reading devices (sound emitting sections) 304, the DSP 306, a mixer 308, and a bus interface 310 as shown in FIG. 3. The waveform generator 302, the DSP 306, and the mixer 308 are connected to the system bus 226 via the bus interface 310 for access to the RAM 208 and communication with the CPU 202. Each waveform reading device 304 of the waveform generator 302 is an oscillator which reads out waveform data from the RAM 208 and generates a timbre waveform. The DSP 306 is a signal processing circuit which provides an acoustic effect to an audio signal. The mixer 308 mixes signals from the waveform generator 302 and/or transmits and receives a signal to and from the DSP 306 so as to control the flow of an audio signal as a whole, and outputs the resultant signal to the outside. That is, the mixer 308 provides an envelope in accordance with a musical sound parameter supplied from the CPU 202 by the DSP 306 to waveform data read out from the RAM 208 by each waveform reading device 304 of the waveform generator 302 in accordance with a musical performance, and outputs the resultant data as output musical sound waveform data. An output signal from the mixer 308 is outputted via the D/A converter 228 and the amplifier 230 to a speaker, headphone, or the like omitted in the drawing as an analog signal at a predetermined signal level, as shown in FIG. 2.

(Waveform Data Management Method)

Here, waveform data stored in the above-described RAM and large-capacity flash memory is described in detail.

Figures 4A, 4B:
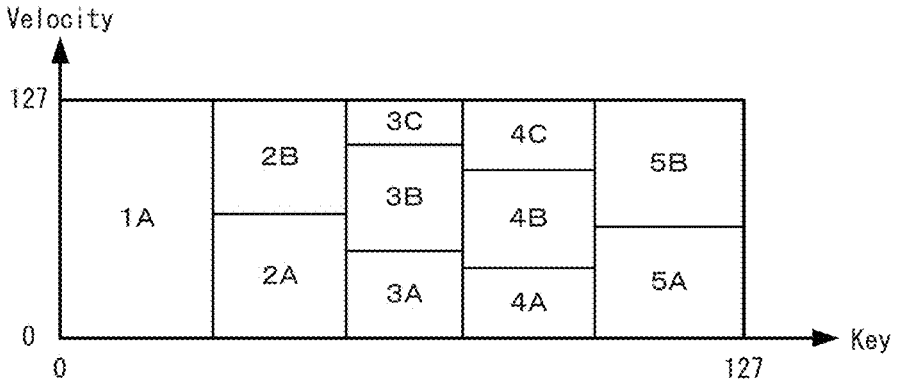
FIG. 4A and FIG. 4B are diagrams for describing a waveform data management method applied in the present embodiment.

FIG. 4A and FIG. 4B are diagrams for describing a waveform data management method applied in the present embodiment. FIG. 4A is a diagram for describing a timbre waveform split, and FIG. 4B is a diagram for describing a timbre waveform directory.

In the present embodiment, by the instrument player depressing a timbre selection button 104 provided to the electronic keyboard instrument 100, one of the sixteen types of timbres is selected for a musical performance. As a result, timbre waveform data for each pitch or sound volume is read out from the large-capacity flash memory 212 to the RAM 208 in order to reproduce a change not only in sound volume and pitch but also in timbre based on a key area and/or velocity. Here, each timbre is constituted by, for example, thirty-two types of waveforms at maximum per timbre, and the waveform data thereof are stored in the large-capacity flash memory 212. As a method for managing waveform data for each pitch or sound volume for one timbre, a management method based on a timbre waveform split structure is applied in which waveform data is assigned for each key area ("Key" on the horizontal axis in the drawing) in which the instrument player performs a musical performance on the keyboard 102 and is also assigned for each velocity ("Velocity" on the vertical axis in the drawing) indicating a key depression speed (a strength in a musical performance) even in the same key area. That is, in the waveform data management method using a timbre waveform split structure, a sound area and a velocity area for one timbre are two-dimensionally split, and each split area is assigned with thirty-two waveforms at maximum. According to this management method, only one waveform is determined to be read out based on two factors including a velocity and a key number (key area) at the time of key depression.

Waveform data stored in the RAM 208 and the large-capacity flash memory 212 are managed based on timbre waveform directory information in a table format. The timbre waveform directory information is stored in the large-capacity flash memory 212, and is read out by the CPU 202 from the large-capacity flash memory 212 at, for example, the start of the electronic keyboard instrument 100 and transferred to the RAM 208. When a musical sound with a certain timbre is played, the CPU 202 reads out from the RAM 208 the data of timbre waveform directory information corresponding to that timbre for reference.

Here, the timbre waveform directory information table has registered thereon item values for each waveform data included in one timbre with a "timbre number", which include "waveform number" of that waveform data, "minimum velocity", "maximum velocity", "smallest key number" and "largest key number" indicating the ranges of a key area and a velocity in which the sound of the waveform data is to be emitted, "address from waveform area start" indicating an address from the start of the storage area (waveform area) of the timbre transferred to the RAM 208, and "waveform size" indicating the data size of that waveform data, as shown in FIG. 4B. That is, in the timbre waveform directory information, information for each waveform data of each timbre is defined in a table format, which is key area and velocity area information indicating a condition based on which a split is made in the above-described timbre waveform split structure and information regarding an address where the data is actually arranged in the large-capacity flash memory 212 and a waveform size.

(Information in RAM and Large-Capacity Flash Memory)

Next, information in the RAM and the large-capacity flash memory and its transfer processing applied in the electronic keyboard instrument according to the present embodiment are described with reference to the drawings.

Figure 5:
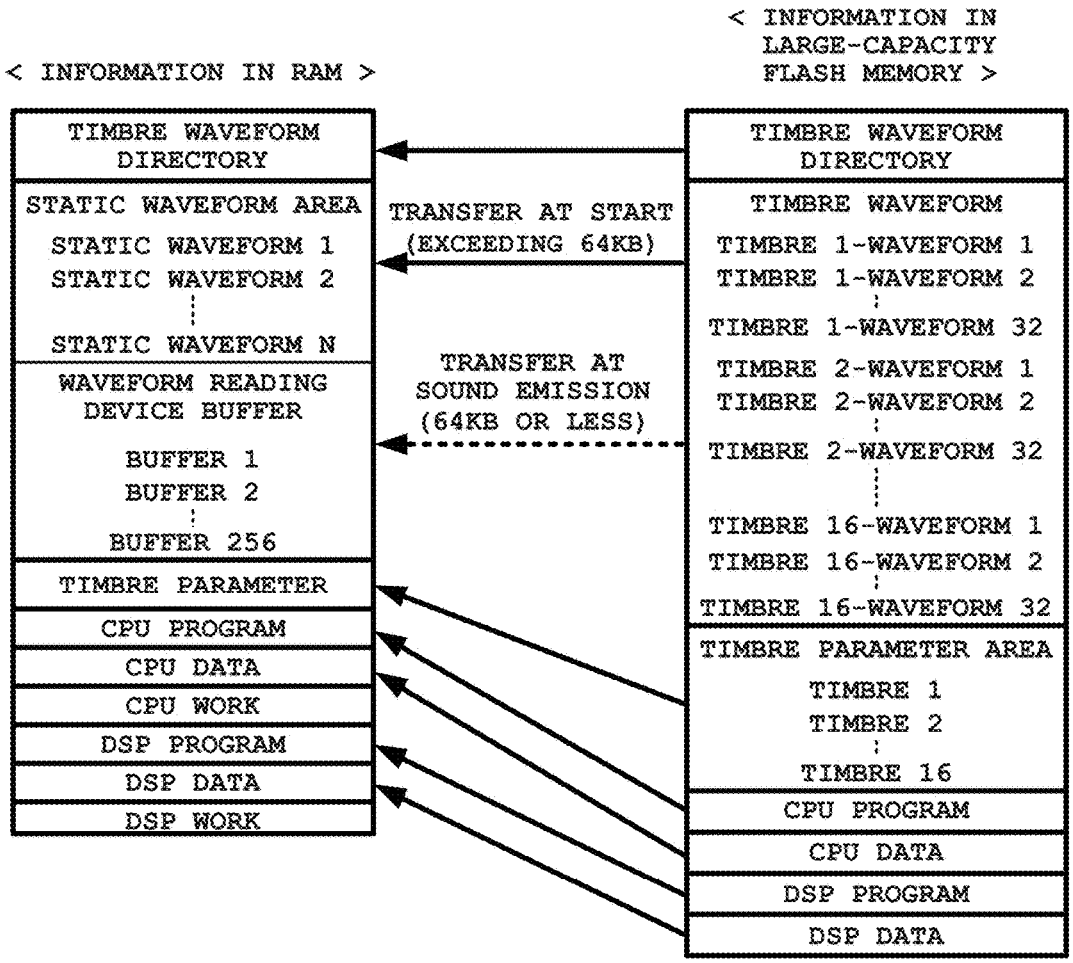
FIG. 5 is a diagram outlining information on a RAM (Random Access Memory) and a large-capacity flash memory and its transfer processing applied in the present embodiment.

FIG. 5 is a diagram outlining information on the RAM and the large-capacity flash memory and its transfer processing applied in the present embodiment. FIG. 6A and FIG. 6B are diagrams for describing a static waveform area and a dynamic waveform area of the RAM applied in the present embodiment. FIG. 6A shows details of a directory on the static waveform area (first storage area), and FIG. 6B shows details of a directory on a waveform reading device buffer area (second storage area) that is the dynamic waveform area.

In the RAM 208, various data are developed, such as the data of a timbre waveform directory, timbre parameters, a CPU program, CPU data, CPU work, a DSP program, DSP data, and DSP work, as shown in "INFORMATION IN RAM" at the left in FIG. 5. Also, in the large-capacity flash memory 212, various data are developed, such as the data of a timbre waveform directory, a timbre parameter area, a CPU program, CPU data, a DSP program, and DSP data, as shown in "INFORMATION IN LARGE-CAPACITY FLASH MEMORY" at the right in FIG. 5.

Here, when the sound source LSI 204 is to perform a waveform reading operation in a musical performance using the electronic keyboard instrument 100, waveform data to be read out is required to be arranged in the RAM 208. For this reason, for example, when the electronic keyboard instrument 100 is activated, the timbre waveform directory information, the timbre parameters, the CPU program, the CPU data, the DSP program, and the DSP data shown in FIG. 4B are transferred from the large-capacity flash memory 212 to the RAM 208.

Also, at the time of a musical performance by the electronic keyboard instrument 100, waveform data that is a target of a waveform reading operation by the sound source LSI 204 is required to be transferred to the RAM 208. However, since the RAM 208 has a smaller storage capacity as compared to the large-capacity flash memory 212, pieces of timbre waveform data stored in the large-capacity flash memory 212 cannot be entirely arranged in the RAM 208.

In the present embodiment, basically, when a sound is to be emitted by a musical performance, necessary waveform data is read out from the large-capacity flash memory 212, transferred to a waveform buffer assigned for each waveform reading device 304 on the RAM 208 so as to be temporarily stored, and then read out and replayed by the sound source LSI 204. Here, when the waveform data has a large data size, it takes time to transfer the data from the large-capacity flash memory 212 to the RAM 208, which causes a delay in the sound emission, and possibly disrupts the musical performance. In the present embodiment, from among waveform data stored in the large-capacity flash memory 212, all pieces of waveform data having a data size exceeding a predetermined threshold value are transferred in advance to the RAM 208 at any timing prior to the start of a musical performance by the electronic keyboard instrument 100, such as its activation timing (power-up). In the present embodiment, for example, 64K bytes are set as a threshold value defining a data size as a criterion of judgment in waveform data transfer processing. According to this threshold setting, for example, the data size of the timbre waveform of an instrument such as the piano or cymbals is larger than the threshold, and is thus transferred to the RAM 208 at the start.

On the other hand, low-capacity waveform data having a data size equal to or smaller than the threshold value (64K bytes), such as the data of the timbre waveform of an instrument such as the guitar, is transferred from the large-capacity flash memory 212 to the RAM 208 every time a key depression operation is performed for a musical performance. Here, for waveform data transferred from the large-capacity flash memory 212 in a musical performance, from among a plurality of waveform buffers on the RAM 208 set corresponding to the plurality of waveform reading devices 304, a waveform buffer not being used from any waveform reading device 304 is selected for overwriting and storing the transferred waveform data. Alternatively, a waveform buffer with a small number of times of use by the waveform reading devices or with a low frequency of use is preferentially selected, and the selected waveform buffer is overwritten and updated with the transferred waveform data. This management at the time of transferring waveform data from the large-capacity flash memory 212 to a waveform buffer is performed based on management information for managing (on a real time basis) while performing sequential updates as to whether waveform data stored in each waveform buffer of the RAM 208 is being used for sound emission by any waveform reading device 304.

The threshold value applied in the above-described waveform data transfer processing is set based on, for example, a processing load, delay time, and the like of the CPU 202 at the time of a musical performance. Specifically, in a musical performance by the electronic keyboard instrument 100, the instrument player generally tends to recognize that a response to key depression until sound emission is slow if a total delay time from key depression to emission of a musical sound exceeds approximately 10 msec. In consideration of the processing performance of the CPU 202, a signal delay in a peripheral circuit, and the like, a delay time allowable in processing of transferring each timbre waveform data is calculated. Then, a timbre waveform data size allowing the transfer processing to be completed within this certain allowable delay time and also allowing the storage capacity of the RAM 208 to be minimized as much as possible is set as a threshold value. An example of the threshold value calculated by the inventors based on this condition is 64K bytes.

In the present embodiment, a threshold value is set for the data size of a timbre waveform. However, the present invention is not limited thereto. For example, a configuration may be adopted in which a threshold value is set for a pitch or velocity defining a timbre waveform based on the above-described concept.

Also, in the present embodiment, in order to reduce the processing load and processing time of the CPU 202 during a musical performance, the CPU 202 judges (searches), prior to the above-described processing of transferring waveform data whose data size is equal to or smaller than the threshold value, whether the waveform data of a musical sound specified by musical performance has been transferred in advance and is present in the RAM 208. If the relevant waveform data is already present in the RAM 208, the CPU 202 does not perform waveform data transfer from the large-capacity flash memory 212, and uses the waveform data in the RAM 208. This waveform data using method will be described in detail further below.

In the present embodiment, because of the above-described processing, it is only required that a RAM 208 is adopted which has a storage capacity acquired by adding a storage capacity of a waveform buffer which temporarily stores waveform data smaller than the threshold value to a capacity capable of storing all pieces of waveform data exceeding the above-described threshold. According to verification by the inventors, by the present embodiment being applied, the storage capacity for use as a RAM can be compressed to substantially ¼ to ⅕ of a conventional storage capacity.

A "STATIC WAVEFORM DIRECTORY" shown in FIG. 6A indicates details of a directory in the static waveform area of the RAM 208 in the "INFORMATION IN RAM" shown in FIG. 5 where waveform data exceeding the threshold value (64K bytes) applied to the above-described waveform data transfer processing is stored. When the electronic keyboard instrument 100 is activated, all pieces of waveform data exceeding the threshold value (64K bytes) are transferred from the timbre waveform directory of the large-capacity flash memory 212 to each area (storage area) of the static waveform area and, at this moment, this static waveform directory is created in the work area (CPU work) of the CPU 202, as shown in FIG. 5. The details of the static waveform directory are fixedly stored and are not changed after the activation of the electronic keyboard instrument 100.

For each piece of the waveform data (static waveforms 1, 2, . . . , N) transferred from the large-capacity flash memory 212, the static waveform directory has stored therein a timbre number to which the waveform belongs, a timbre waveform number, a start address from a static waveform area where the waveform has been arranged, and the waveform size of the waveform data, as shown in FIG. 6A. Here, the number of static waveforms to be transferred from the large-capacity flash memory 212 and the capacity of the entire waveform data have been defined in advance based on the above-described threshold value, and therefore a static waveform area on the RAM 208 and each area on the static waveform directory have been fixedly assigned corresponding thereto.

A "WAVEFORM READING DEVICE BUFFER DIRECTORY" shown in FIG. 6B indicates details of a directory in the dynamic waveform area of the RAM 208 in the "information on the RAM" shown in FIG. 5 where waveform data equal to or smaller than the threshold value (64K bytes) applied in the above-described waveform data transfer processing is stored. In this waveform reading device buffer directory, at the time of a musical performance by the electronic keyboard instrument 100, waveform data equal to or smaller than the threshold value (64K bytes) is transferred from the timbre waveform directory of the large-capacity flash memory 212 to each area (storage area) of the waveform reading device buffer area as shown in FIG. 5, and allocated in the work area (CPU work) of the CPU 202. The details of the waveform reading device buffer directory are variably stored with musical performance, and updated at the time of sound emission or silence of a musical sound.

In the waveform reading device buffer directory, a capacity with a fixed length of 64K bytes is assigned for each waveform reading device 304, and waveform buffers 1 to 256 are set corresponding to the 256 waveform reading devices 304 in a one-to-one relation, whereby the electronic keyboard instrument 100 of the present embodiment can emit 256 sounds simultaneously.

The waveform reading device buffer directory has stored, for each waveform buffer corresponding to each waveform reading device 304, a buffer number, a link flag, a link buffer number, a transfer flag, an accessing count, a timbre number, a timbre waveform number, and a waveform size, as shown in FIG. 6B. The link flag is a flag indicating whether a waveform buffer corresponding to a waveform reading device 304 that is a processing target is using waveform data stored in a waveform buffer corresponding to another waveform reading device 304 in the waveform data use processing described below. When the waveform buffer is using that waveform data, "1" is set. When the waveform buffer is not using that waveform data, "0" is set. The link buffer number stores the number of the waveform buffer where the waveform data being used in the waveform buffer of the processing target is present. Here, a link for the use of the waveform data cannot be set for the waveform buffer of the processing target. Therefore, if the waveform data remains in the waveform buffer corresponding to the assigned waveform reading device 304 (processing target), no link is set, and that waveform buffer is directly used for a waveform data reading operation.

Also, the transfer flag is a flag indicating whether a waveform data transfer from a waveform buffer whose waveform data is to be used has been actually completed. If completed, the transfer flag is set at "1". The accessing counter indicates the number of waveform reading devices 304 from which a waveform buffer whose waveform data is to be used is being accessed. This count is incremented at the time of sound emission, and is decremented at the time of the completion of reading. Thus, when this count indicates "0", the waveform buffer has not been used. The timbre number, the timbre waveform number, and the waveform size are information unique to waveform data read into a waveform buffer. Specifically, for example, in a waveform buffer with a buffer number of "2" shown in FIG. 6B, the link flag is "1" and the link buffer number is "4", which indicates that waveform data stored in the waveform buffer with a buffer number of "4" is being used. Also, the transfer flag is "1" and the accessing count is "2", which indicates that the waveform data of the waveform buffer "4" has actually been read, and waveform buffers corresponding to two waveform reading devices 304 are accessing and reading the waveform buffer "4".

These pieces of information stored in the waveform reading device buffer directory, which are information indicating the storage status and use status of waveform data in each waveform buffer in the RAM 208 (that is, the link destination setting and the use status of each waveform buffer), are included in the above-described management information, and managed while being sequentially updated (in real time).

<Electronic Instrument Control Method>

Next, a method of controlling the electronic keyboard instrument (musical sound generation method) according to the present embodiment is described in detail with reference to the drawings. Here, the method of controlling the electronic keyboard instrument including the musical sound generation method, which is a feature of the present invention, is described as a whole. Note that a series of control processing described below is achieved by the CPU 202 and the sound source LSI 204 executing a predetermined control program stored in the RAM 208.

(Method of Using Waveform Data in RAM)

First, a method of using waveform data in the RAM 208 applied in the electronic keyboard instrument 100 according to the present embodiment is described. In the electronic keyboard instrument 100 according to the present embodiment, at the time of key depression by the instrument player, the CPU 202 first determines a waveform reading device 304 of the sound source LSI 204 to which the key depression is assigned by a key assigner because the number of simultaneous sound emissions is large (that is, many sound emission channels are present). Here, a key assignment to a waveform reading device 304 where sound emission has been stopped is prioritized. However, even when the waveform reading device 304 itself has stopped reading, if the waveform buffer of that waveform reading device 304 is being read out by another waveform reading device 304, the CPU 202 does not assign that waveform reading device 304 and judges that the current state is maintained as much as possible.

More specifically, the CPU 202 sequentially updates and manages (in real time) history information indicating in which order the waveform reading devices 304 have been used and for which waveform data reading operation they have been used. Based on this history information, the CPU 202 prioritizes and assigns a waveform reading device 304 associated with a waveform buffer that is not being used by any waveform reading device 304 for a waveform data reading operation, a waveform reading device 304 with a low frequency of use, a waveform reading device 304 that is obsolete in time, or a waveform reading device 304 with read waveform data of a small data size, and causes a waveform reading operation to be performed.

Next, based on the velocity and key area at the time of the key depression, the CPU 202 identifies the waveform number of a musical sound specified by the musical performance from the timbre waveform split information shown in FIG. 4A, and judges whether the relevant waveform data is present in the timbre waveform directory in the RAM 208 shown in FIG. 5. Here, the CPU 202 first judges whether the relevant waveform data is present in the static waveform area of the timbre waveform directory in the RAM 208 and, if the relevant data is not present in the static waveform area, further judges whether the relevant waveform data is present in the waveform reading device buffer area that is a dynamic waveform area.

When the relevant waveform data is present in the static waveform area in the RAM 208, the CPU 202 takes the relevant waveform data as a reading operation target for sound emission described below. Also, when the relevant waveform data is not present in the static waveform area but in the waveform reading device buffer area, the CPU 202 does not read out the waveform data from the large-capacity flash memory 212 and sets the buffer area as a link destination in the same RAM 208 so as to use the waveform data.

This allows the waveform data to be arranged in the RAM 208 in a very short time as compared to transfer processing from the large-capacity flash memory 212 to the RAM 208. When the relevant waveform data is already present in the waveform buffer corresponding to the assigned waveform reading device 304, the waveform data is not required to be transferred, and the already present waveform data is used for a reading operation for sound emission. On the other hand, when the relevant waveform data is not present in both the static waveform area and the waveform reading device buffer area, the CPU 202 transfers the relevant waveform data stored in the large-capacity flash memory 212 to the RAM 208.

When the waveform data of the specified musical sound is present in the RAM 208 and the position of the waveform buffer corresponding to the assigned waveform reading device 304 is defined, the CPU 202 starts a reading operation for sound emission in the sound source LSI 204.

Hereafter, an electronic keyboard instrument control method where the above-described waveform data using method has been applied is described in detail.

(Main Routine)

Figure 7:
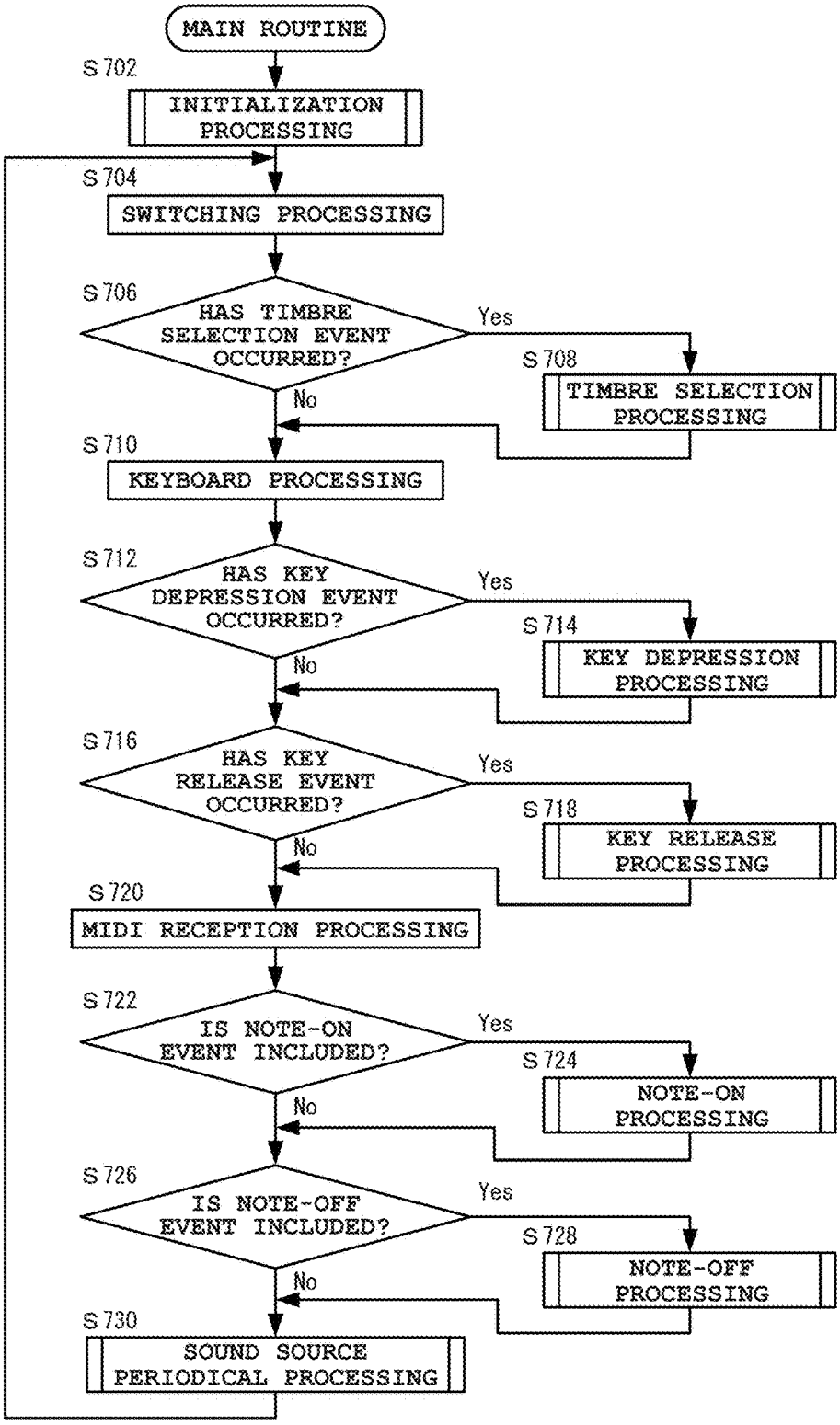
FIG. 7 is a flowchart of the main routine of an electronic keyboard instrument control method according to the present embodiment.

FIG. 7 is a flowchart of the main routine of the electronic keyboard instrument control method according to the present embodiment.

In the electronic keyboard instrument control method according to the present embodiment, processing operations described below are generally performed. First, when the instrument player powers up a device power supply of the electronic keyboard instrument 100, the CPU 202 starts the main routine shown in FIG. 7 to perform initialization processing for initializing each section of the device (Step S702).

Next, when the initialization processing is completed, the CPU 202 repeatedly performs (Steps S704 to S708) a series of processing operations including switching processing when the instrument player operates any timbre selection button 104 or the like, keyboard processing (Steps S710 to S718) for processing a key depression event and a key release event when the instrument player plays the keyboard 102, MIDI reception processing (Steps S720 to S728) for processing a note-on event and a note-off event of a MIDI (Musical Instrument Digital Interface) message received from outside the electronic keyboard instrument 100, and sound source periodical processing (Step S730) for performing processing for each predetermined time in the sound source.

Although not shown in the flowchart of FIG. 7, when a state change such as the end or interruption of a musical performance mode or the power-off of the device power supply is detected during the above-described processing operations (Steps S702 to S730), the CPU 202 forcibly ends the main routine.

Hereafter, each of the above-described processing operations is specifically described.

(Initialization Processing)

Figure 8:
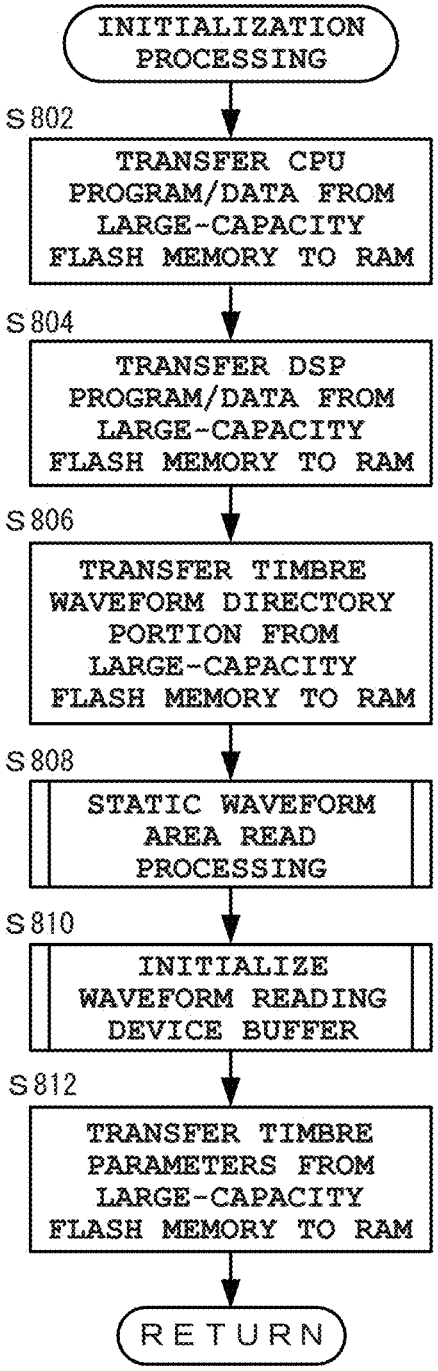
FIG. 8 is a flowchart of initialization processing applied in the electronic keyboard instrument control method according to the present embodiment.

FIG. 8 is a flowchart of the initialization processing applied in the electronic keyboard instrument control method according to the present embodiment.

In the initialization processing applied in the electronic keyboard instrument control method according to the present embodiment, after transferring the CPU program, the CPU data, the DSP program, and the DSP data from the large-capacity flash memory 212 to the RAM 208 (Steps S802 and S804), the CPU 202 further transfers a timbre waveform directory portion from the large-capacity flash memory 212 to an address specified on the RAM 208 (Step S806), as shown in the flowchart of FIG. 8. Here, the timbre waveform directory portion has a table format having organized therein key area and velocity area information serving as a split condition, an arrangement address in the large-capacity flash memory 212, and information regarding a wavelength size for each waveform of each timbre, as shown in FIG. 4B.

Next, the CPU 202 performs static waveform area read processing of constructing a static waveform area portion and the static waveform directory shown in FIG. 6A to be transferred from this timbre waveform directory into the RAM 208, in the RAM 208 at the time of starting the electronic keyboard instrument 100 (Step S808).

Next, the CPU 202 performs waveform reading device buffer initialization processing of initializing a waveform buffer corresponding to each waveform reading device 304 so as to construct the waveform reading device buffer directory portion shown in FIG. 6B which is used by the waveform reading device 304 of the sound source LSI 204 for performing a waveform data reading operation (Step S810).

Next, the CPU 202 transfers timbre parameters required for sound emission such as a pitch, filter, and sound-volume setting from the large-capacity flash memory 212 into the RAM 208 (Step S812).

(Static Waveform Area Read Processing)

Figure 9:
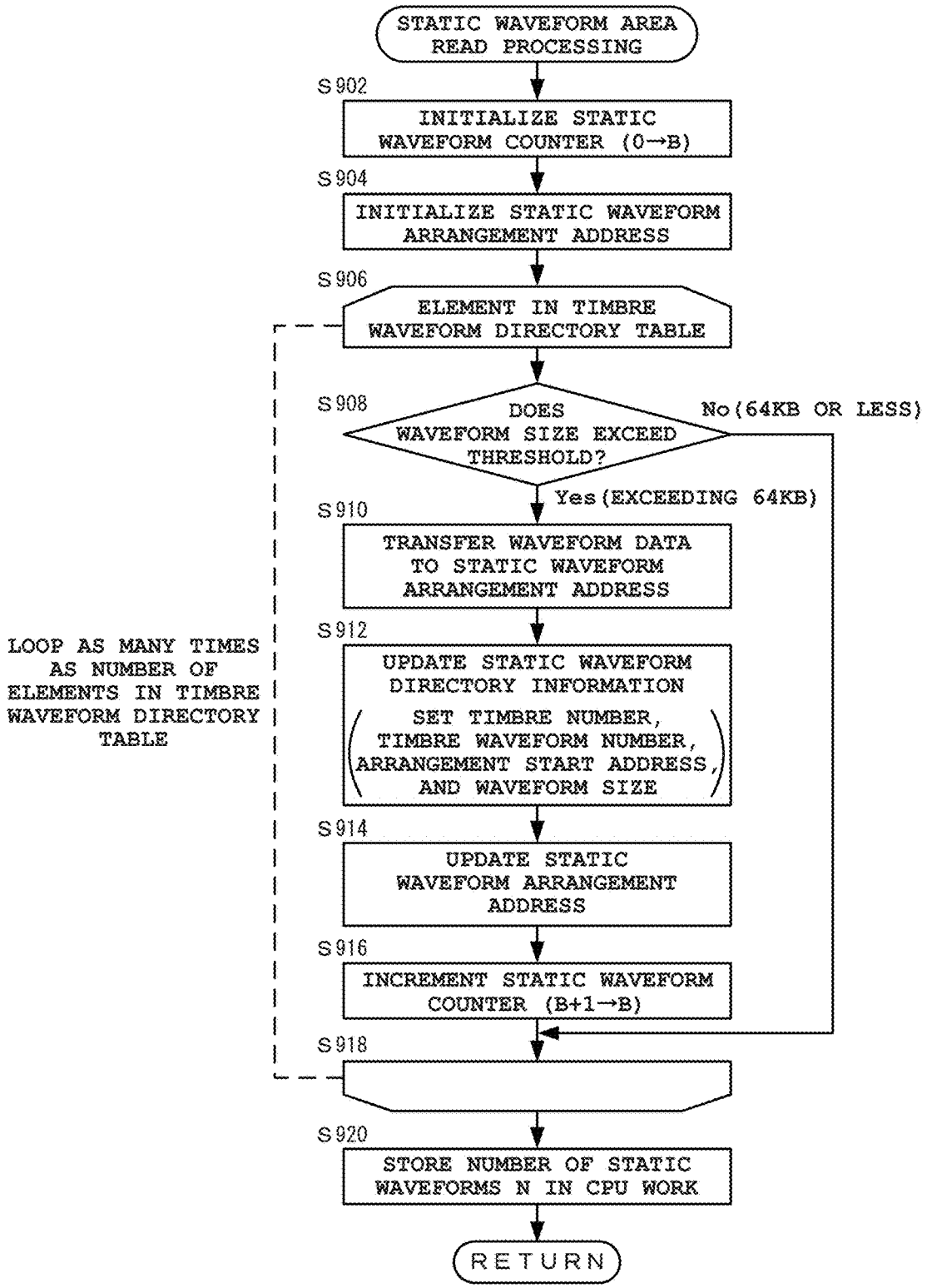
FIG. 9 is a flowchart of static waveform area read processing applied in the initialization processing of the electronic keyboard instrument control method according to the present embodiment.

FIG. 9 is a flowchart of static waveform area read processing applied in the initialization processing of the electronic keyboard instrument control method according to the present embodiment.

In the static waveform area read processing applied in the initialization processing described above, the CPU 202 first initializes to "0" a counter B for managing the number of static waveforms (Step S902), as shown in the flowchart in FIG. 9. Next, as address information when a static waveform is transferred into the RAM 208, the CPU 202 sets a start address where the static waveform is to be arranged for initialization (Step S904).

Next, the CPU 202 confirms the waveform size sequentially from the start of the timbre waveform directory table, and judges whether the waveform is a static waveform having a waveform size exceeding the threshold value (64K bytes) set in advance (Step S908). When the waveform size exceeds the threshold (64K bytes), the CPU 202 judges that the waveform is a static waveform, and transfers the waveform data for that size from the large-capacity flash memory 212 to the address in the RAM 208 in the above-described address information (Step S910). Here, as static waveform directory information, the CPU 202 sets the timbre number, the timbre waveform number, the arrangement start address, and the waveform size of the transferred waveform data in the CPU work (Step S912).

Next, the CPU 202 adds the waveform size of the transferred waveform data to the address of the address information so as to update the address information of the waveform arranged in the RAM 208 (Step S914), and increments the counter B which manages the number of static waveforms (Step S916). On the other hand, when the waveform size is equal to or smaller than the threshold value (64K bytes), the CPU 202 does not transfer the static waveform data, and maintains the current settings. The CPU 202 performs loop processing (Steps S906 and S918) of repeating the above-described series of processing operations (Steps S908 to S916) as many times as the number of elements on the timbre waveform directory table (that is, until the last element of the table information). After the loop processing is ended, the CPU 202 stores the number of static waveforms in the CPU work (Step S920).

(Waveform Reading Device Buffer Initialization Processing)

Figure 10:
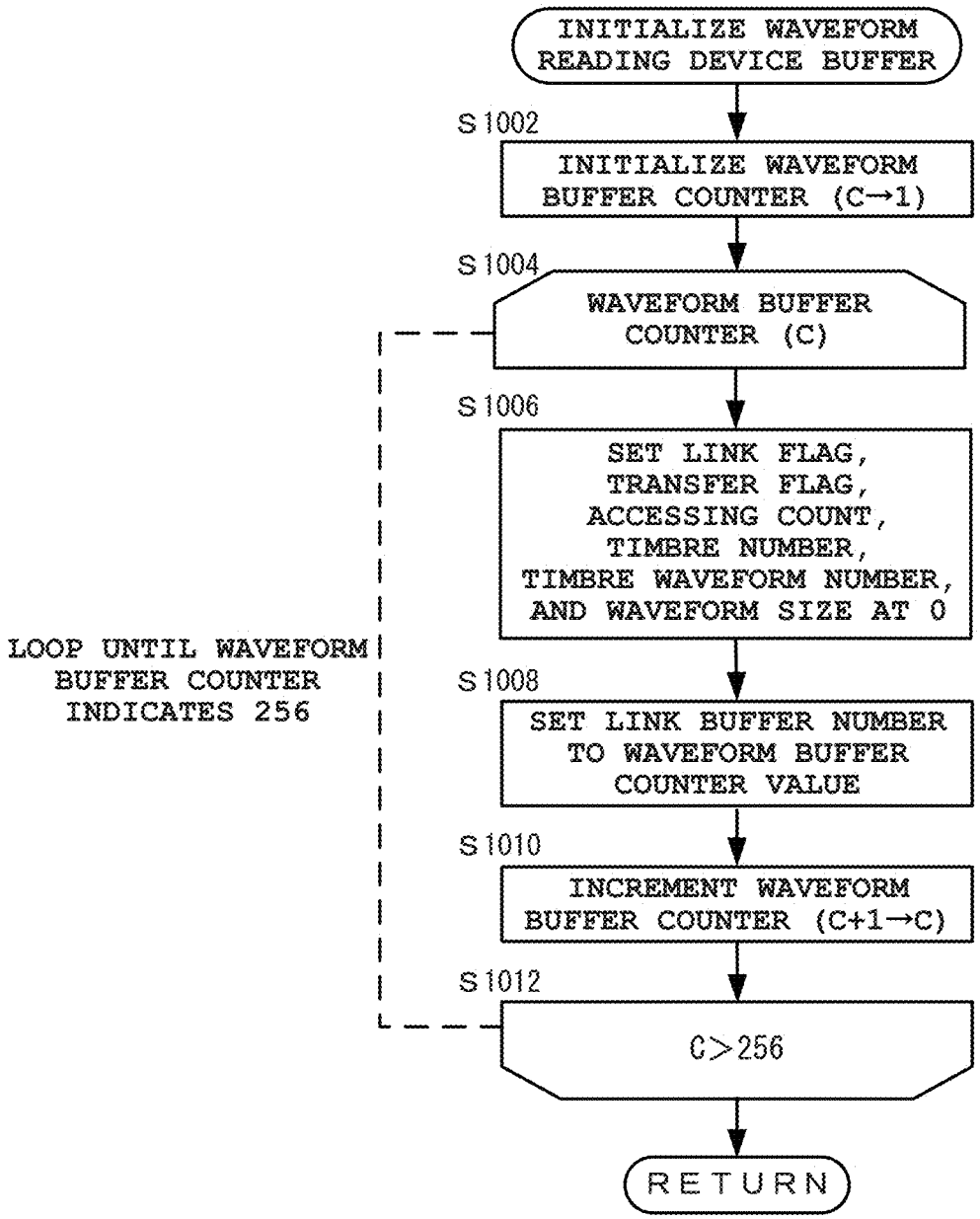
FIG. 10 is a flowchart of waveform reading device buffer initialization processing applied in the initialization processing of the electronic keyboard instrument control method according to the present embodiment.

FIG. 10 is a flowchart of waveform reading device buffer initialization processing applied in the initialization processing of the electronic keyboard instrument control method according to the present embodiment.

In the waveform reading device buffer initialization processing applied in the above-described initialization processing, the CPU 202 first sets a counter (C) which manages the numbers of waveform buffers arranged in the RAM 208 at "1" for initialization (Step S1002), as shown in the flowchart in FIG. 10. Next, sequentially from a waveform buffer with a buffer number of "1", the CPU 202 sets the link flag, the transfer flag, the accessing count, the timbre number, the timbre waveform number, and the waveform size stored in the waveform reading device buffer directory at "0" (Step S1006), and sets the link buffer number at the waveform buffer number (=counter value) of the processing target (Step S1008). Thus, if the waveform buffer number and the link buffer number are the same, a state is set in which a reading operation is being performed not on another waveform buffer but on the processing target waveform buffer.

Next, the CPU 202 increments the counter (C) which manages the numbers of waveform buffers arranged in the RAM 208 (Step S1010). The CPU 202 performs loop processing (Steps S1004 and S1012) of repeating the above-described series of processing operations (Steps S1006 to S1010) in each of the 256 wave buffers having a one-to-one relation with the 256 waveform reading devices so as to initialize each wave buffer.

(Switching Processing)

Figure 11:
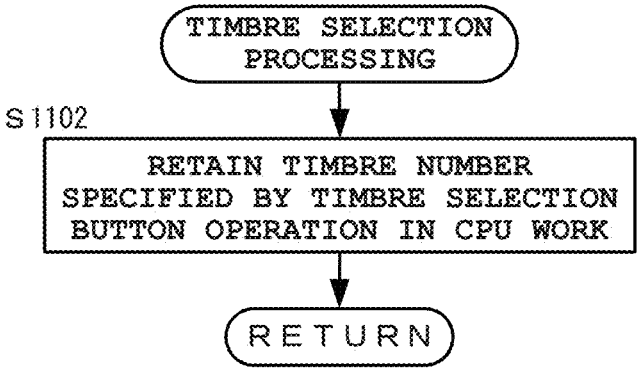
FIG. 11 is a flowchart of timbre selection processing applied in switching processing of the electronic keyboard instrument control method according to the present embodiment.

FIG. 11 is a flowchart of timbre selection processing applied in switching processing of the electronic keyboard instrument control method according to the present embodiment.

In the switching processing performed when the instrument player operates a button, switch, or the like provided on the electronic keyboard instrument 100 (Step S704), the CPU 202 judges whether a timbre selection event has occurred by that switching operation (Step S706). When judged that a timbre selection event has occurred, the CPU 202 performs timbre selection processing (Step S708).

In the timbre selection processing, as in the flowchart shown in FIG. 11, the CPU 202 stores a timbre number specified by the instrument player operating a timbre selection button 104 in the CPU work in the RAM 208 for use in, for example, key depression processing described below or the like (Step S1102). On the other hand, when the CPU 202 judges that a timbre selection event has not occurred or when the above-described timbre selection processing is ended, the CPU 202 performs keyboard processing described below (Step S710).

(Keyboard Processing)

Figure 12A:
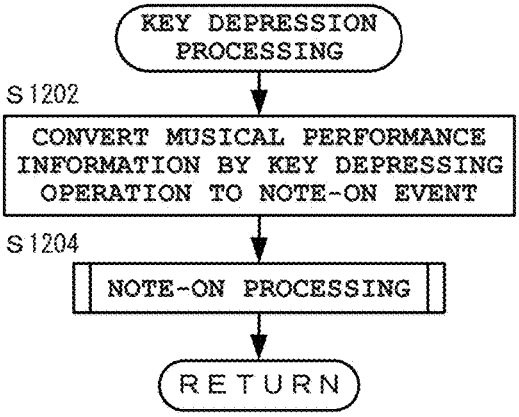
FIG. 12A and FIG. 12B are flowcharts of key depression processing and key release processing applied in keyboard processing of the electronic keyboard instrument control method according to the present embodiment.
Figure 12B:
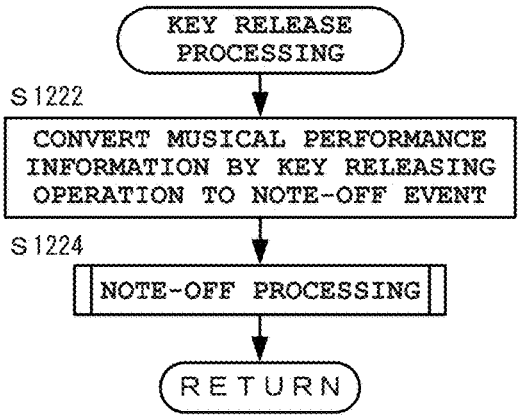
Figure 13A:
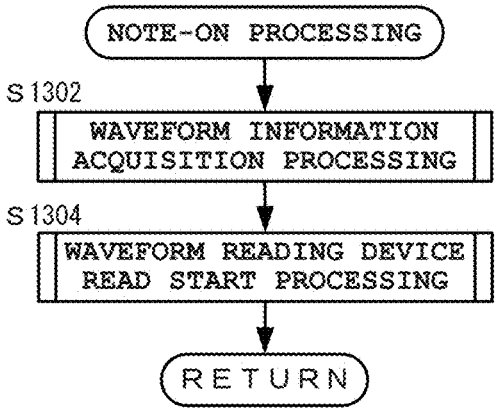
FIG. 13A and FIG. 13B are flowcharts of note-on processing and note-off processing applied in the keyboard processing of the electronic keyboard instrument control method according to the present embodiment.
Figure 13B:
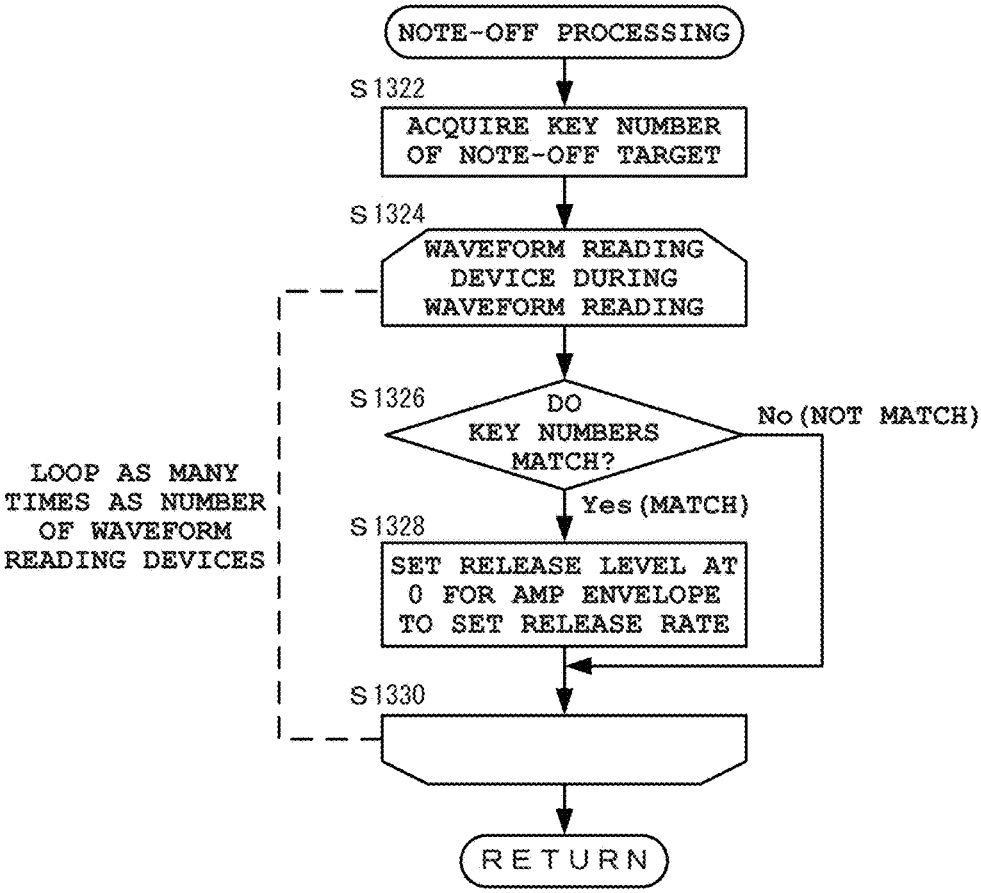

FIG. 12A and FIG. 12B are flowcharts of key depression processing and key release processing applied in keyboard processing of the electronic keyboard instrument control method according to the present embodiment. FIG. 13A and FIG. 13B are flowcharts of note-on processing and note-off processing applied in the keyboard processing of the electronic keyboard instrument control method according to the present embodiment.

In the keyboard processing (Step S710) performed after the above-described switching processing (Step S704), the CPU 202 judges whether or not a key depression event or a key release event has occurred by the instrument player operating the keyboard 102 provided on the electronic keyboard instrument 100 (Steps S712 and S716). When judged that a key depression event has occurred, the CPU 202 performs key depression processing described below (Step S714). When judged that a key release event has occurred, the CPU 202 performs key release processing described below (Step S718).

In the key depression processing, the CPU 202 converts a keyboard position and a depression strength included in musical performance information based on a key depressing operation performed by the instrument player playing the keyboard 102 to a key number (note number) and a velocity, respectively, retains them as note-on information (Step S1202), and performs processing with it as a note-on event (Step S1204), as shown in the flowchart in FIG. 12A.

In the note-on processing, the CPU 202 first performs processing of acquiring waveform information from the note-on information acquired by the conversion from the musical performance information in the key depression processing (Step S1302), and then performs read start processing in the waveform reading device 304 of the sound source LSI 204 (Step S1304), as shown in the flowchart in FIG. 13A.

Also, in the key release processing, the CPU 202 converts a keyboard position included in musical performance information based on a key release operation performed by the instrument player playing the keyboard 102 to a key number (note number), retains the key number as note-off information (Step S1222), and performs processing with it as a note-off event (Step S1224), as shown in the flowchart in FIG. 12B.

In the note-off processing, the CPU 202 first acquires the key number (note number) from the note-off information acquired by the conversion from the musical performance information in the key release processing (Step S1322), as shown in the flowchart in FIG. 13B. Next, sequentially from a waveform reading device 304 with a number of "1", the CPU 202 judges the status of the waveform reading device 304 and, for each waveform reading device 304 reading waveform data, acquires a key number corresponding to the waveform reading device 304 from the CPU work in the RAM 208 so as to judge whether this key number matches the key number acquired from the note-off information (Step S1326). When the key numbers match, the CPU 202 sets a release level at "0" for the sound volume control (amp envelope) connected to the waveform reading device 304, and sets a release rate acquired from the timbre parameters in the RAM 208 (Step S1328). On the other hand, when the key numbers do not match, the CPU 202 maintains the current setting of the amp envelope. The CPU 202 performs loop processing (Steps S1324 and S1330) of repeating the above-described series of processing operations (Steps S1326 to S1328) as many times as the number of waveform reading devices 304 reading waveform data.

Here, each processing operation applied in the note-on processing performed in the above-described keyboard processing is described in detail.

(Waveform Information Acquisition Processing)

Figure 14:
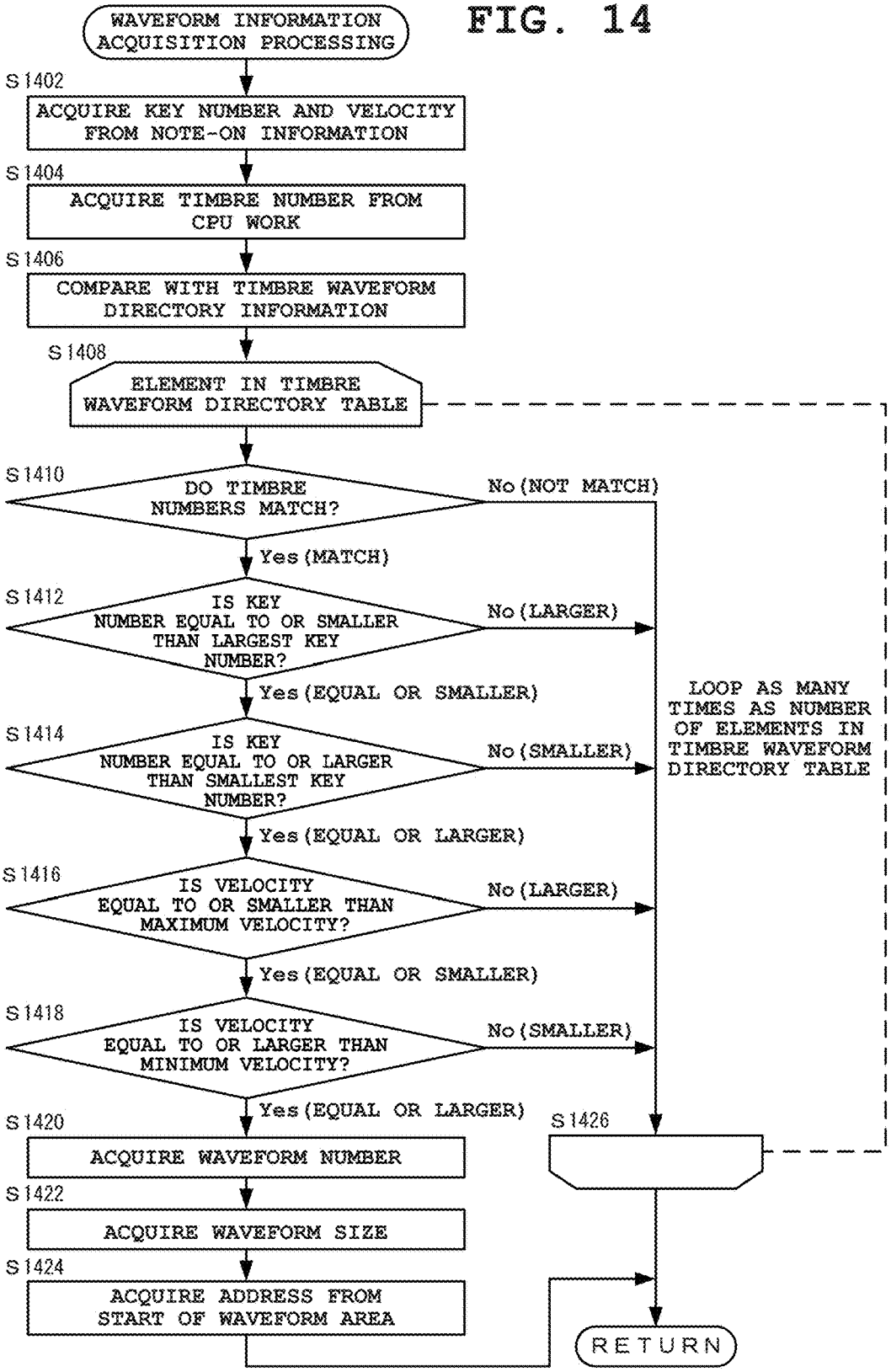
FIG. 14 is a flowchart of waveform information acquisition processing applied in note-on processing of the electronic keyboard instrument control method according to the present embodiment.

FIG. 14 is a flowchart of waveform information acquisition processing applied in the note-on processing of the electronic keyboard instrument control method according to the present embodiment.

In the waveform information acquisition processing performed in the note-on processing, the CPU 202 first acquires the key number (note number) and the velocity from the note-on information acquired in the key depression processing (Step S1402), and also acquires the timbre number stored in the timbre selection processing from the CPU work in the RAM 208 (Step S1404), as shown in the flowchart in FIG. 14.

Next, sequentially from the start of the timbre waveform directory table, the CPU 202 makes a comparison as to whether the acquired key number, velocity, and timbre number match those of the table information (Step S1406). In this comparison processing, the CPU 202 extracts table information where the timbre number matches the acquired timbre number, the key number is equal to or smaller than the largest key number and is equal to or larger than the smallest key number, and the velocity is equal to or smaller than the maximum velocity and equal to or larger than the minimum velocity (Steps S1410 to S1418), and acquires a waveform number, a waveform size, and an address from the start of the waveform area in the table (Steps S1420 to S1424). On the other hand, in the above-described comparison processing, the CPU 202 does not acquire waveform information such as a waveform number when the timbre numbers do not match, the key number is larger than the largest key number or smaller than the smallest key number, or the velocity is larger than the maximum velocity or smaller than the minimum velocity. The CPU 202 performs loop processing (Steps S1408 and S1426) of repeating the above-described series of processing operations (Steps S1410 to S1418) as many times as the number of elements on the timbre waveform directory table (that is, until the last element of the table information).

(Waveform Read Start Processing)

Figure 15:
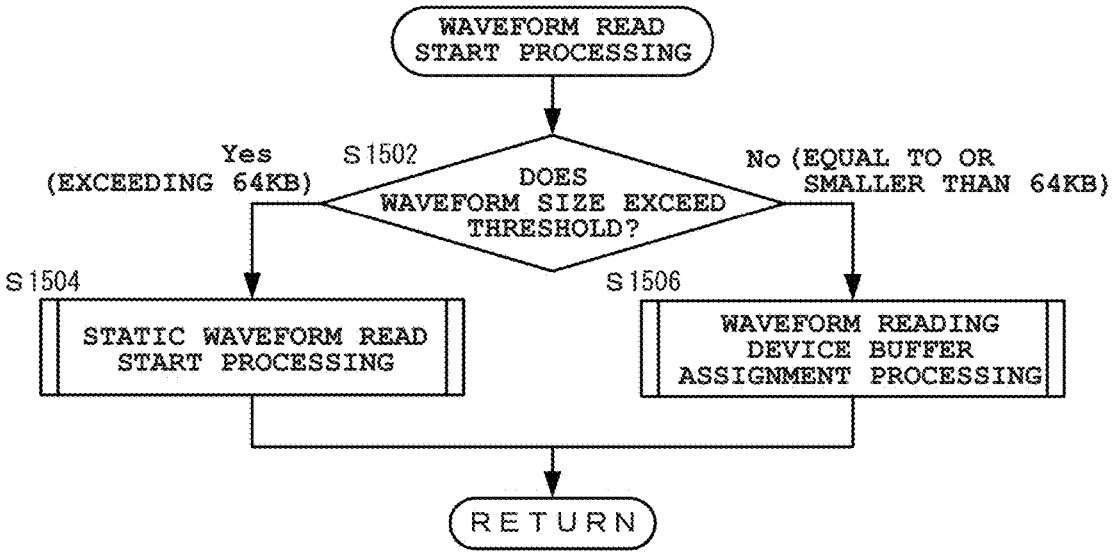
FIG. 15 is a flowchart of waveform read start processing by a waveform reading device applied in the note-on processing of the electronic keyboard instrument control method according to the present embodiment.

FIG. 15 is a flowchart of waveform read start processing by the waveform reading device applied in the note-on processing of the electronic keyboard instrument control method according to the present embodiment.

In the waveform read start processing that is performed by the waveform reading device in the note-on processing, the CPU 202 judges whether the waveform size acquired in the waveform information acquisition processing exceeds the threshold value (64K bytes) set in advance (Step S1502). When the waveform size exceeds the threshold value (64K bytes), the CPU 202 performs static waveform read start processing described below (Step S1504), as in the flowchart shown in FIG. 15. On the other hand, when the waveform size is equal to or smaller than the threshold value (64K bytes), the CPU 202 performs waveform reading device buffer assignment processing described below (Step S1506 ).

(Static Waveform Read Start Processing)

Figure 16:
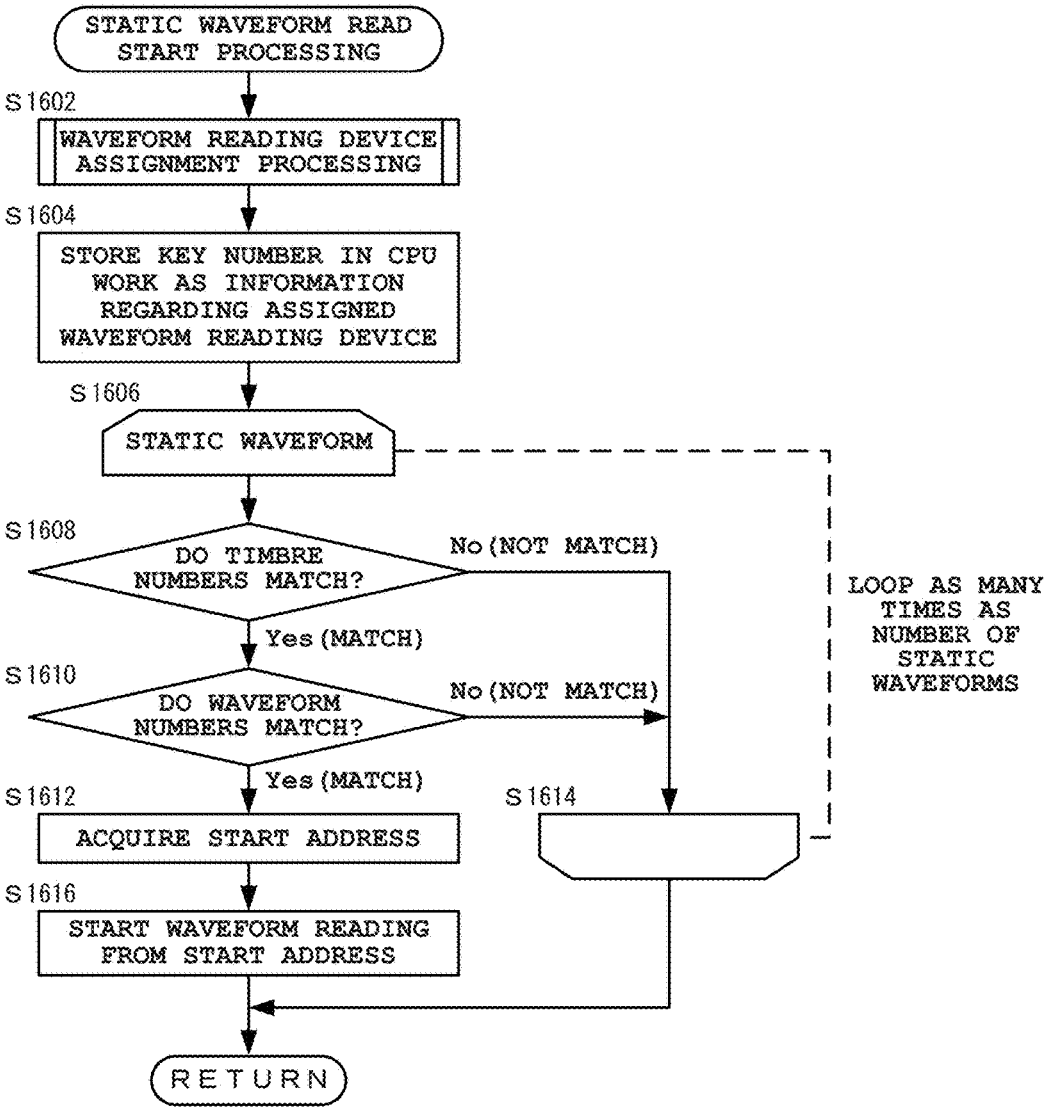
FIG. 16 is a flowchart of static waveform read start processing applied in the note-on processing of the electronic keyboard instrument control method according to the present embodiment.

FIG. 16 is a flowchart of static waveform read start processing applied in the note-on processing of the electronic keyboard instrument control method according to the present embodiment.

In the static waveform read start processing that is performed when the waveform size acquired in the note-on processing exceeds the threshold (64K bytes), the CPU 202 first performs assignment processing for determining which waveform reading device 304 is to be used in the waveform generator 302 of the sound source LSI 204 (Step S1602), as in the flowchart shown in FIG. 16. The processing of assigning a waveform reading device 304 will be described further below. Next, as information regarding the assigned waveform reading device 304, the CPU 202 stores the key number acquired in the key depression processing for use in the key release processing (note-off processing) and the like, in the CPU work in the RAM 208 (Step S1604).

Next, sequentially from the start of the static waveform directory, the CPU 202 makes a comparison as to whether the timbre number and the waveform number acquired in the above-described timbre selection processing and waveform information acquisition processing match those of the directory information (Steps S1608 and S1610). When the acquired timbre number and waveform number both match those of the directory information, the CPU 202 acquires the start address where the waveform has been arranged in the RAM 208 based on the static waveform number (Step S1612), and starts a waveform reading operation by the assigned waveform reading device 304 from the acquired start address (Step S1616). On the other hand, in the above-described comparison processing, if either one of the acquired timbre number or waveform number does not match a relevant one of the directory information, CPU 202 does not acquire the start address. The CPU 202 performs loop processing (Steps S1606 and S1614) of repeating the above-described series of processing operations (Steps S1608 to S1610) as many times as the number of static waveforms stored in the CPU work.

(Waveform Reading Device Assignment Processing)

Figure 17:
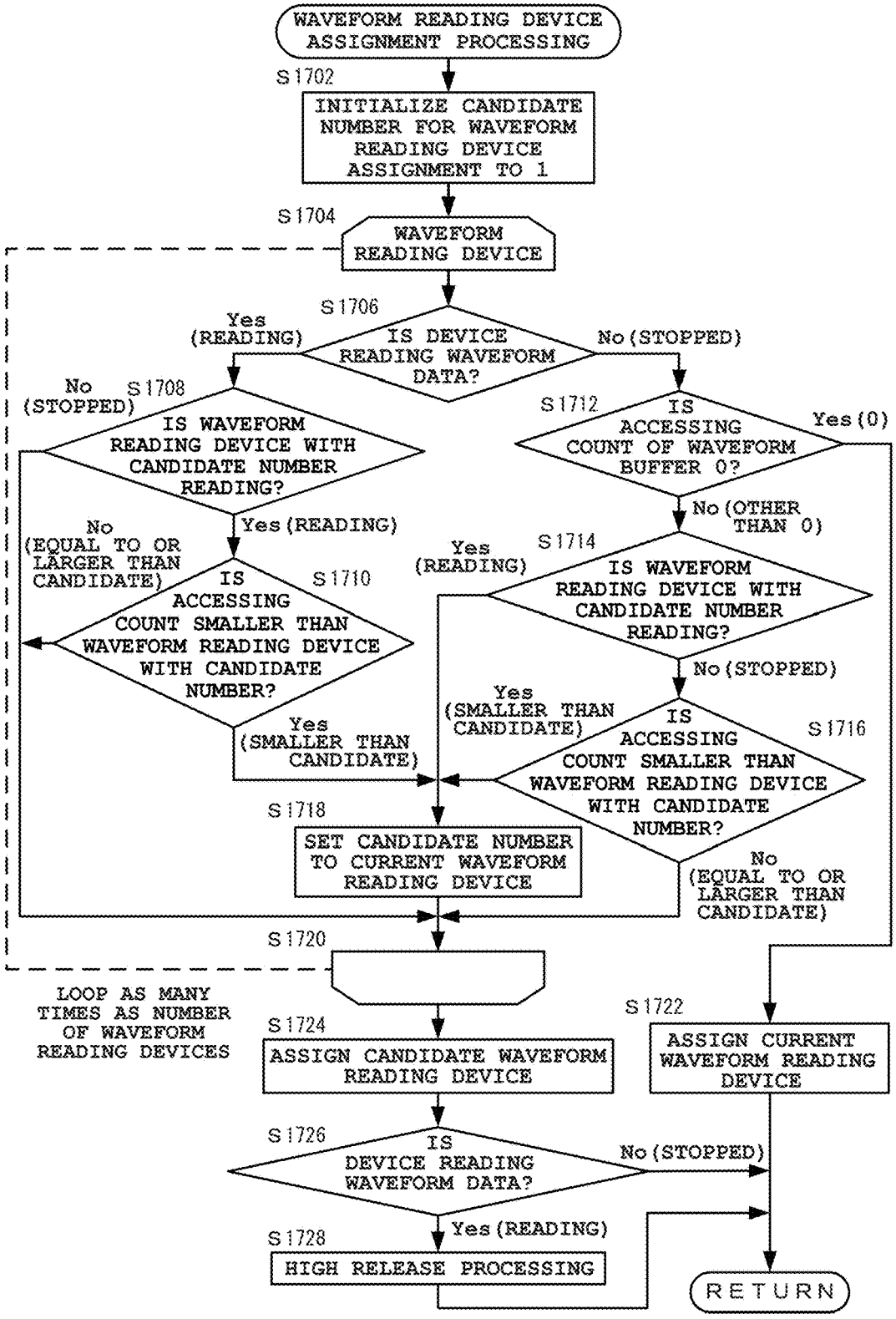
FIG. 17 is a flowchart of waveform reading device assignment processing applied in the note-on processing of the electronic keyboard instrument control method according to the present embodiment.

FIG. 17 is a flowchart of waveform reading device assignment processing applied in the note-on processing of the electronic keyboard instrument control method according to the present embodiment.

In the waveform reading device assignment processing that is performed in the above-described static waveform read start processing, the CPU 202 first provisionally sets a candidate number for waveform reading device 304 assignment at "1" for initialization (Step S1702), as in the flowchart shown in FIG. 17.

Next, sequentially from the waveform reading device 304 with a number of "1", the CPU 202 judges the status of the waveform reading device 304 so as to judge whether the device is reading out waveform data (Step S1706). When the current waveform reading device 304 is reading out waveform data, the CPU 202 confirms, based on the number (candidate number) of the waveform reading device 304 as an assignment candidate, the state of the waveform reading device 304 with that candidate number (Step S1708). When the waveform reading device 304 with the candidate number is reading out waveform data, the CPU 202 makes a comparison between an accessing count value of the number of the current waveform reading device 304 and an accessing count value of the candidate number of the waveform reading device to be assigned (Step S1710). When the accessing count value of the candidate number of the waveform reading device 304 to be assigned is larger (that is, when the accessing count value of the number of the current waveform reading device 304 is smaller than the accessing count value of the candidate number of the waveform reading device to be assigned), the CPU 202 updates and sets the candidate number of the waveform reading device 304 to be assigned to the number of the current waveform reading device 304 (Step S1718).

On the other hand, at Step S1708, when the waveform reading device 304 with the candidate number is not reading out waveform data, the CPU 202 judges that the waveform reading device 304 has been stopped, and does not update the number of the waveform reading device 304 so as to maintain the current settings. Also, at Step S1710, when the accessing count value of the candidate number of the waveform reading device 304 to be assigned is small (that is, when the accessing count value of the number of the current waveform reading device 304 is equal to or larger the accessing count value of the candidate number of the waveform reading device to be assigned), the CPU 202 does not update the number of the waveform reading device 304 and maintains the current settings.

On the other hand, at Step S1706, when the current waveform reading device 304 is not reading out waveform data (stops), the CPU 202 judges whether the accessing count value of the waveform buffer corresponding to the number of the current waveform reading device 304 is "0" (Step S1712). When the accessing count value is "0", the CPU 202 judges that no access has been made from another waveform reading device 304 to the waveform buffer and the waveform reading operation has been stopped, and assigns the current waveform reading device 304 (Step S1722).

On the other hand, at Step S1712 when the accessing count value is other than "0", the CPU 202 judges that the waveform buffer is being accessed from another waveform reading device 304, and confirms the status of the waveform reading device 304 with the assignment candidate number (Step S1714). When the waveform reading device 304 with the candidate number is reading out waveform data, the CPU 202 updates and sets the candidate number of the waveform reading device 304 to be assigned to the number of the current waveform reading device 304 (Step S1718).

On the other hand, when the waveform reading device 304 with the candidate number is not reading out waveform data, the CPU 202 judges that the waveform reading device 304 has been stopped, and makes a comparison between the accessing count value of the number of the current waveform reading device 304 and the accessing count value of the candidate number of the waveform reading device to be assigned (Step S1716). When the accessing count value of the candidate number of the waveform reading device 304 to be assigned is larger (that is, when the accessing count value of the number of the current waveform reading device 304 is smaller than the accessing count value of the candidate number of the waveform reading device to be assigned), the CPU 202 updates and sets the candidate number of the waveform reading device 304 to be assigned to the number of the current waveform reading device 304 (Step S1718).

On the other hand, at Step S1716, when the accessing count number of the candidate number of the waveform reading device 304 to be assigned is smaller (that is, when the accessing count value of the number of the current waveform reading device 304 is equal to or larger than the accessing count value of the candidate number of the waveform reading device to be assigned), the CPU 202 does not update the number of the waveform reading device 304 and maintains the current settings. The CPU 202 performs loop processing (Steps S1704 and S1720) of repeating the above-described series of processing operations (Steps S1706 to S1718) as many times as the number of waveform reading devices 304.

After the loop processing has ended, if the number of the waveform reading device 304 to be assigned has not been defined when status confirmation is performed by an amount equal to the number of waveform reading devices 304, the CPU 202 assigns the waveform reading device with the candidate number for static waveform (Step S1724). Here, the CPU 202 judges whether the assigned waveform reading device 304 is reading waveform data (Step S1726). If the device is reading waveform data, the CPU 202 high release processing (processing of rapidly setting the sound volume level at "0" in the sound volume control connected to the waveform reading device 304) (Step S1728), and then stops the waveform reading operation of the assigned waveform reading device 304. On the other hand, if the device is not reading waveform data, the CPU 202 judges that the waveform reading device 304 is in a stopped state, and maintains the current settings.

(Waveform Reading Device Buffer Assignment Processing)

Figure 19:
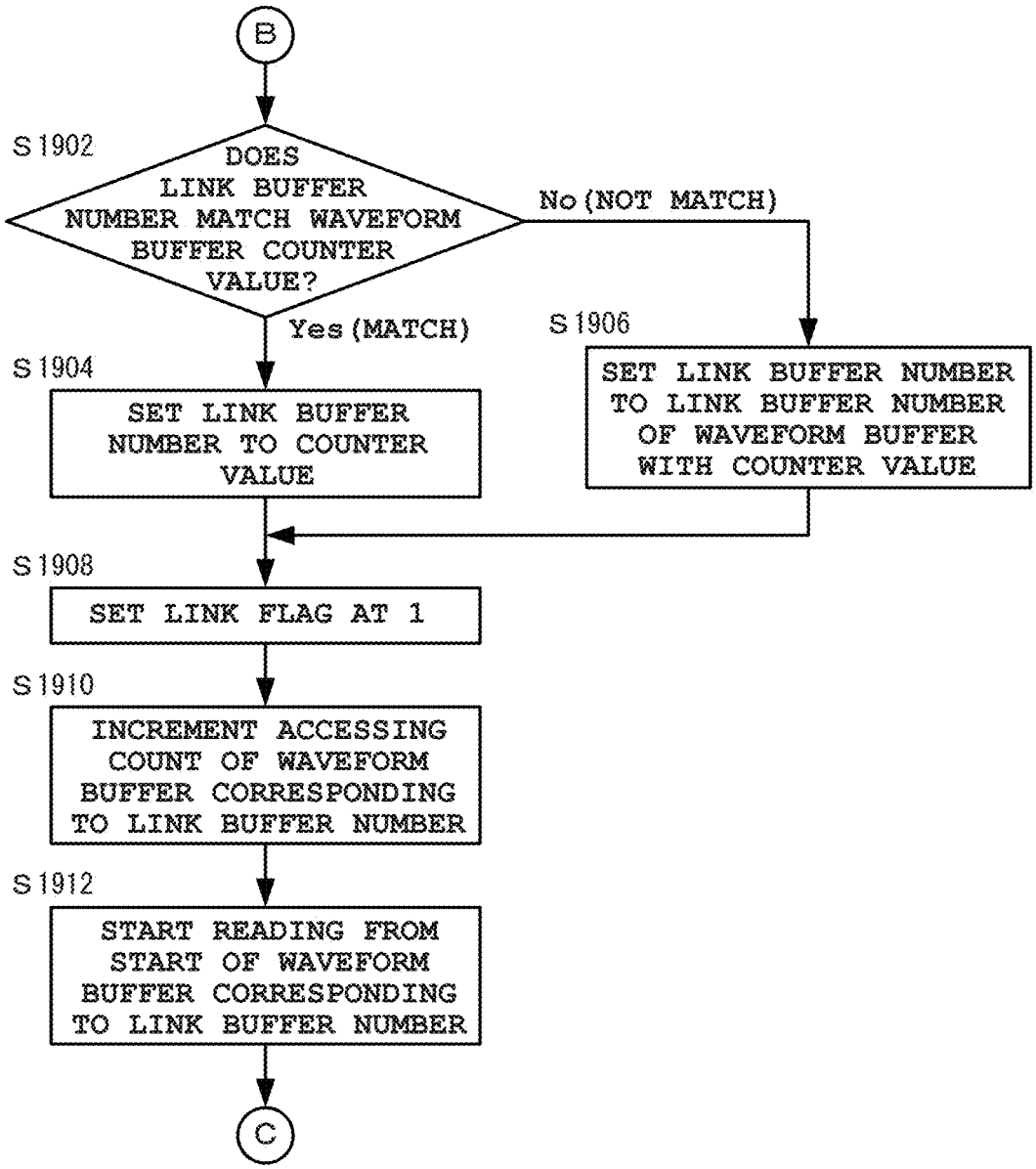
FIG. 19 is a second flowchart of the waveform reading device buffer assignment processing applied in the note-on processing of the electronic keyboard instrument control method according to the present embodiment.

FIG. 18 and FIG. 19 are flowcharts of waveform reading device buffer assignment processing applied in the note-on processing of the electronic keyboard instrument control method according to the present embodiment.

In the waveform reading device buffer assignment processing that is performed when the waveform size acquired in the note-on processing is equal to or smaller than the threshold value (64K bytes), the CPU 202 first performs assignment processing of determining which waveform reading device 304 is to be used in the waveform generator 302 of the sound source LSI 204 (S1802), as in the flowchart shown in FIG. 18 and FIG. 19. Here, processing equivalent to the processing of assigning the waveform reading device 304 (Step S1602) shown in FIG. 16 and FIG. 17 is applied.

Next, as information regarding the assigned waveform reading device 304, the CPU 202 stores the key number at this point in the CPU work (Step S1804). Next, the CPU 202 makes a comparison as to whether the timbre number and waveform number acquired in the above-described timbre selection processing and waveform information acquisition processing match those of the information of the waveform buffer corresponding to the assigned waveform reading device 304 (Steps S1806 to S1810). When the acquired timbre number and waveform number both match those of the information regarding the waveform buffer, the CPU 202 judges that the waveform data has already been transferred (Step S1812), and starts a waveform reading operation from the start of the processing target waveform buffer (Step S1838). On the other hand, in the above-described comparison processing, when either one of the timbre number and the waveform number does not match a relevant one of the information regarding the waveform buffer, the CPU 202 judges whether the waveform data has already been transferred to another waveform buffer.

First, the CPU 202 initializes the waveform buffer counter (C) to be "1" (Step S1814) and, sequentially from the waveform buffer with a buffer number of "1", makes a comparison as to whether the timbre number and the waveform number acquired from the above-described timbre selection processing and waveform information acquirement processing match those of the waveform information stored in each waveform buffer (Steps S1818 and S1820). When the timbre number and the waveform number match those of the waveform information, the CPU 202 stops the above-described comparison processing, and makes a comparison as to whether the counter value of the matched waveform buffer and the link buffer number match each other (Step S1902). When the link buffer number matches the waveform buffer counter value, the CPU 202 sets the number of this waveform buffer to the link buffer number of the processing target waveform buffer (Step S1904). On the other hand, when the link buffer number does not match the waveform buffer counter, the CPU 202 sets the link buffer number of this waveform buffer to the link buffer number of the processing target waveform buffer (Step S1906).

Next, the CPU 202 sets the link flag of the processing target waveform buffer at "1" (Step S1908), increments the accessing count value of the waveform buffer corresponding to the link buffer number of the processing target waveform buffer (Step S1910), and starts a waveform reading operation from the start address of the waveform buffer corresponding to the link buffer number of the processing target waveform buffer (Step S1912). That is, an operation of newly transferring from the large-capacity flash memory 212 the waveform data already transferred to the RAM 208 is not performed. The CPU 202 performs loop processing (Steps S1816 and S1822) of repeating the above-described series of processing operations (Steps S1818 to S1820) for each of the 256 waveform reading devices 304.

In the above-described series of processing operations (Steps S1818 to S1820), when either one of the timbre number and the waveform number does not match a relevant one of the waveform information and both of the timbre number and the waveform number do not match those of the waveform information, the CPU 202 transfers the waveform data from the large-capacity flash memory 212 to the processing target waveform buffer in the RAM 208 based on the waveform number, waveform size, and address information from the start of the waveform area acquired in the waveform information acquisition processing (Step S1824). In addition, simultaneously with this transfer operation, the CPU 202 sets the link flag of the processing target waveform buffer at "0" (Step S1826), and sets the link buffer number of the assigned waveform reading device 304 to the waveform buffer number of the processing target (Step S1828). Furthermore, the CPU 202 sets the accessing count value at "1" (Step S1830) and, with the transfer of the waveform data into the RAM 208, sets a timbre number, a timbre waveform number, and a waveform size in the timbre waveform directory (Step S1832).

Next, the CPU 202 confirms the waveform data transfer status, and judges whether the waveform data transfer has ended (Step S1834). When the waveform data is being transferred, the CPU 202 maintains this state. When the waveform data transfer has ended, the CPU 202 sets the transfer flag at "1" (Step S1836), and starts a waveform reading operation from the start of the processing target waveform buffer (Step S1838).

(MIDI Reception Processing)

Referring back to the main routine shown in FIG. 7, in the MIDI reception processing performed after the above-described keyboard processing (Step S710), the CPU 202 judges whether each received MIDI message includes a note-on event and a note-off event (Steps S722 and S726). When judged that a note-on event is included, the CPU 202 performs note-on processing (Step S724). When judged that a note-off event is included, the CPU 202 performs note-off processing (Step S728). Here, processing equivalent to the note-on processing (Step S1204) or the note-off processing (Step S1224) shown in FIG. 12A, FIG. 12B, FIG. 13A, and FIG. 13B is applied.

(Sound Source Periodical Processing)

Figure 20:
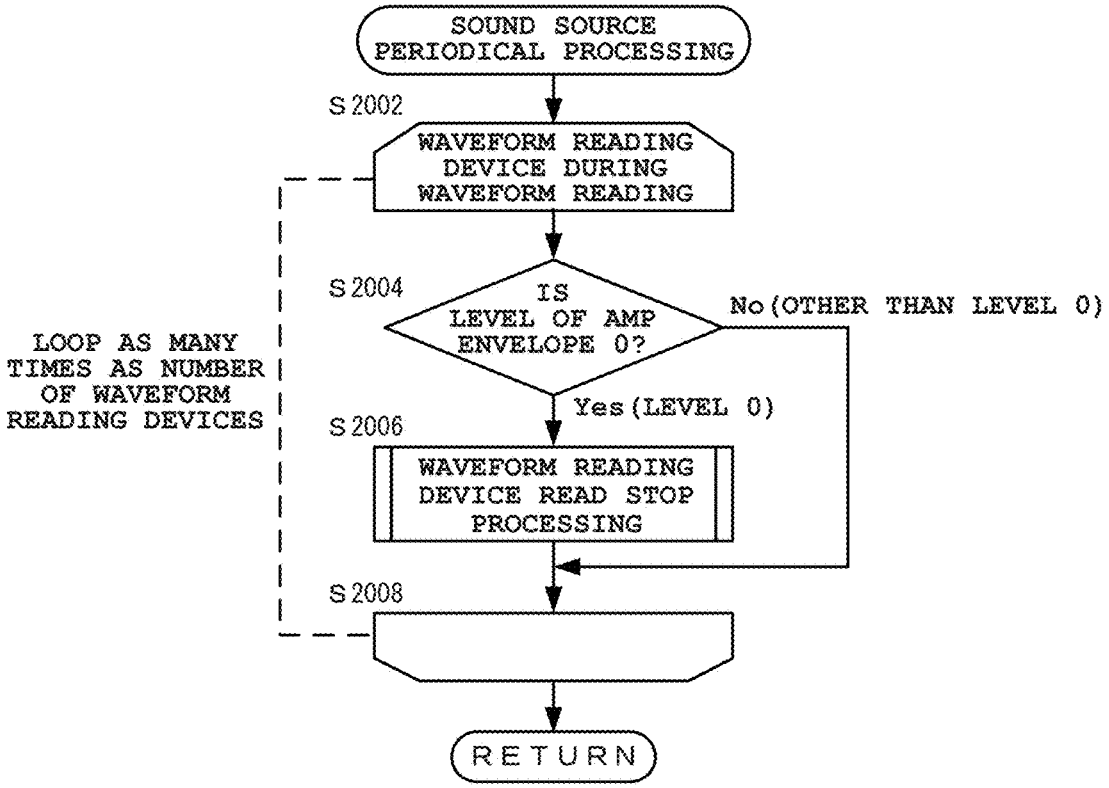
FIG. 20 is a flowchart of sound source periodical processing applied in the electronic keyboard instrument control method according to the present embodiment.

FIG. 20 is a flowchart of sound source periodical processing applied in the electronic keyboard instrument control method according to the present embodiment.

In the sound source periodical processing (Step S730) that is performed after the above-described MIDI reception processing (Step S720), the CPU 202 performs sound source processing at certain time intervals as shown in the flowchart in FIG. 19. Here, sequentially from the waveform reading device 304 with a number of "1", the CPU 202 confirms the status of the waveform reading device 304, and judges whether the level of the sound volume control (amp envelope) is "0" for each waveform reading device 304 reading waveform data (Step S2004). When the level of the sound volume control is "0", the CPU 202 performs waveform reading stop processing of stopping the waveform reading operation of the waveform reading device 304 (Step S2006). On the other hand, when the level of the sound volume control is not "0", the CPU 202 does not stop the waveform reading operation of the waveform reading device 304, and maintains the current state. The CPU 202 performs loop processing (Steps S2002 and S2008) of repeating the above-described series of processing operations (Steps S2004 to S2006) as many times as the number of waveform reading devices 304 reading waveform data.

(Waveform Read Stop Processing)

Figure 21:
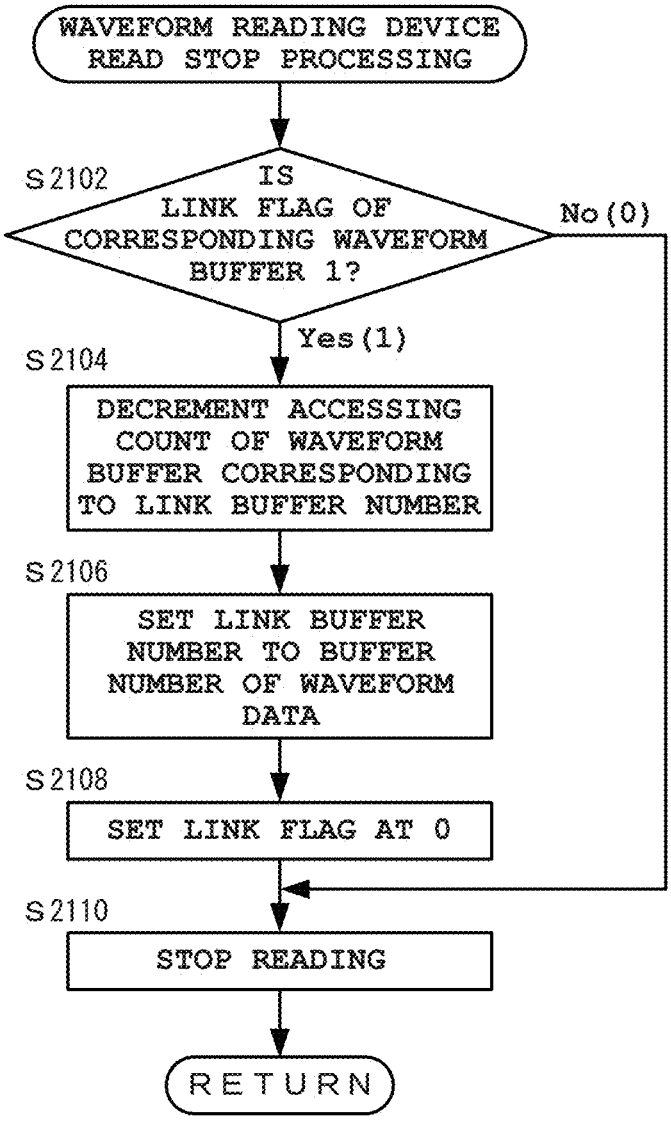
FIG. 21 is a flowchart of waveform read stop processing by the waveform reading device applied in the sound periodical processing of the electronic keyboard instrument control method according to the present embodiment.

FIG. 21 is a flowchart of the waveform read stop processing by the waveform reading device applied in the sound periodical processing of the electronic keyboard instrument control method according to the present embodiment.

In the waveform read stop processing by the waveform reading device which is performed in the sound source periodical process, the CPU 202 first judges whether the link flag value of the waveform buffer corresponding to the waveform reading device 304 is "1" (Step S2102), as in the flowchart shown in FIG. 21. When the link flag value is "1", the CPU 202 decrements the accessing count value of the waveform buffer corresponding to the link buffer number (Step S2104), sets the link buffer number to the waveform buffer number of the processing target (Step S1006), and sets the link flag at "0" (Step S1008). The CPU 202 then stops the waveform reading operation by the waveform reading device 304 (Step S1010). On the other hand, at Step S2102, when the link flag value is "0", the CPU 202 does not update the waveform buffer number of the processing target, and stops the waveform reading operation by the waveform reading device 304 while maintaining the current settings (Step S1010).

As described above, in the present embodiment, the device includes a sound source memory constituted by the RAM 208 which is used by the sound source LSI 204 at the time of sound emission, and a large-capacity storage device constituted by the large-capacity flash memory 212 such as that of an NAND type which stores all pieces of waveform data to be used for timbre. Waveform data with a large data size which takes time to be transferred from the large-capacity storage device to the sound source memory is always arranged in the sound source memory, and waveform data with a relatively small data size is transferred at the time of sound emission from the large-capacity storage device to each waveform buffer of the sound source memory provided for each sound emission generator (waveform reading device 304) for sound emission. Here, before performing to processing of transferring waveform data with a relatively small data size among the pieces of waveform data that sever as reading operation targets for sound emission from the large-capacity storage device to each waveform buffer of the sound source memory, if the waveform data is already present in any of the waveform buffers in the sound source memory, the CPU 202 sets the waveform buffer where the waveform data is stored as a link destination based on the management information which manages the use statuses of the waveform buffers and the like, uses that waveform data in the sound source memory, and directly reads out the waveform data from the sound source memory for sound emission.

Also, in transferring the waveform data from the large-capacity storage device to the sound source memory, a waveform buffer not being used by any sound emission generator or having a low frequency of use is prioritized for selection based on the above-described management information which manages the use statuses of the waveform buffers, and the waveform data is overwritten and stored in that waveform buffer. Furthermore, when a sound emission generator is to be assigned at the time of a key depression by a musical performance, a sound emission generator in a predetermined use status such as a status where a sound emission has been stopped and the frequency of use is low is prioritized for assignment to perform a waveform reading operation, based on the history information which manages the use history of the sound emission generators.

This allows the waveform data with a large data size to be read directly from the sound source memory with a high access speed and the waveform data with a small data size to be directly read by using the waveform data in the sound source memory or to be read from the inexpensive large-capacity storage device for use in musical sound generation processing. Also, even in a case where a plurality of musical sounds are simultaneously emitted by using a plurality of sound emission generators, it is possible to efficiently manage a plurality of waveform data stored in a high-speed, low-capacity sound source memory and manage the sound emission generators to emit the respective sounds based on the waveform data. As a result, in a structure with reduced product cost, a time required for musical sound generation processing using a plurality of waveform data is effectively reduced, and a favorable musical performance without delay or interruption in musical sound generation is achieved. This means that more pieces of timbre waveform data can be read out for simultaneous sound emission within a predetermined time required for musical sound generation processing, which achieves an electronic instrument capable of reproducing musical sounds with a higher degree of fidelity to the original sounds of wind instruments, stringed instruments, and the like.

<Modification Example >

Next, a modification example of the electronic keyboard instrument control method according to the present embodiment is described.

Figure 22:
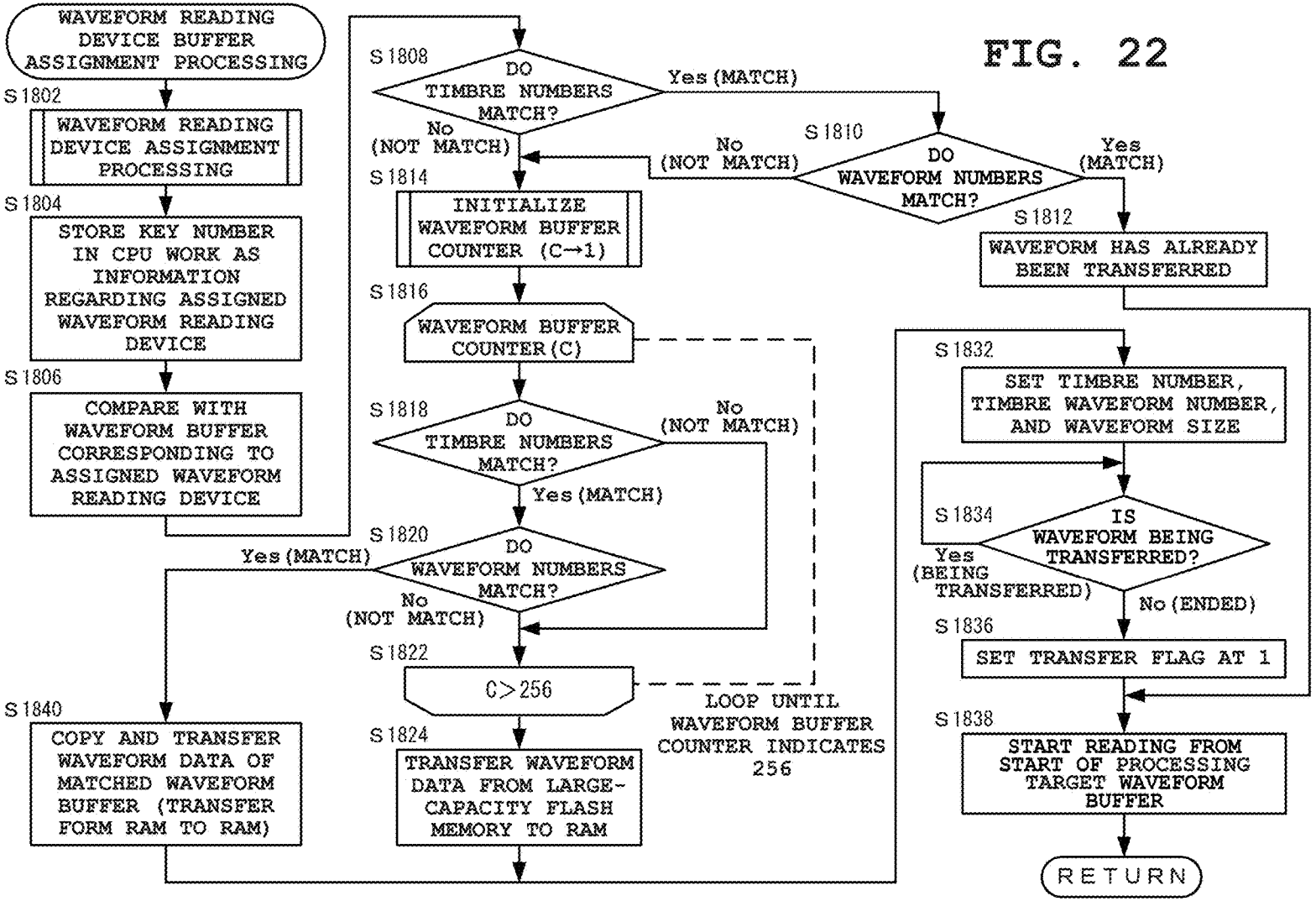
FIG. 22 is a flowchart of waveform reading device buffer assignment processing applied in a modification example of the electronic keyboard instrument control method according to the present embodiment.

FIG. 22 is a flowchart of waveform reading device buffer assignment processing applied in the modification example of the electronic keyboard instrument control method according to the present embodiment. Here, processing operations equivalent to those of the above-described embodiment (FIG. 18 and FIG. 19) are provided with the same reference numerals and not described.

In the above-described embodiment, the method of using waveform data in the RAM 208 has been described in which, prior to the processing of transferring waveform data with a data size equal to or smaller than a threshold value from the large-capacity flash memory 212 to the RAM 208, it is judged whether the waveform data as a reading operation target for sound emission is already present in another waveform buffer in the RAM 208 and, if present, that waveform buffer is set as a link destination, the waveform data stored therein is used in the RAM 208, and the waveform data of the waveform buffer of the link destination is directly read out by the waveform reading device 304.

In the present modification example, as the above-described method of using waveform data in the RAM, a method is used in which the waveform data is copied and transferred from the waveform buffer where the waveform data is already stored to the waveform buffer assigned for a waveform reading operation, and then read out. Here, in the present modification example, as management information, in place of the information regarding the link destination setting and the use status of the waveform buffers in the above-described embodiment, information regarding copy transfer of the waveform data in the RAM 208 between the waveform buffer where the waveform data as a use target is stored and the waveform buffer assigned for the waveform reading operation. In this case as well, the management information is sequentially updated in accordance with the storage status and the copy transfer status of the waveform data in each waveform buffer.

In the electronic keyboard instrument control method according to the present modification example, the following processing is performed in the series of processing operations in the above-described embodiment, in particular, in the waveform reading device buffer assignment processing (FIG. 18 and FIG. 19). That is, as in the flowchart shown in FIG. 22, the CPU 202 makes a comparison as to whether the timbre number and the waveform number of the musical sound instructed in the musical performance match those in the information of waveform data stored in each waveform buffer of the RAM 208 (Step S1818 and S1820). When the timbre number and the waveform number both match those in the information, the waveform data of the matched waveform buffer is copied and transferred to the processing target waveform buffer assigned for a waveform reading operation (Step S1840). Next, with this copy transfer of the waveform data, the CPU 202 sets a timbre number, a timbre waveform number, and a waveform size in the timbre waveform directory (Step S1832), and confirms the transfer status of the waveform data (Step S1834). If the transfer of the waveform data has ended, the CPU 202 sets the transfer flag at "1" (Step S1836). Then, the CPU 202 starts waveform reading from the start of the waveform buffer assigned for the waveform reading operation (Step S1838).

In this modification example as well, the waveform data with a large data size can be read directly from the sound source memory with a high access speed and the waveform data with a small data size can be read by copy transfer in the sound source memory or read from the inexpensive large-capacity storage device for use in musical sound generation processing. Therefore, as with the above-described embodiment, a time required for musical sound generation processing using a plurality of waveform data can be effectively reduced to achieve a favorable musical performance without delay or interruption in musical sound generation.

Also, in the above-described embodiment, a control section which performs various control operations is constituted by a CPU (general-purpose processor) executing a program stored in a ROM (memory). However, the plurality of control operations may be performed by a plurality of dedicated processors, respectively. In this structure, each dedicated processor may be constituted by a general-purpose processor (electronic circuit) that can execute any program and a memory having stored therein a control program tailored to each control, or may be constituted by a dedicated electronic circuit tailored to each control.

Furthermore, devices for acquiring the above-described various effects are not necessarily required to be structured as described above, and may be structured as follows.

(Structural Example 1)

A structure including:

a first memory having a plurality of storage areas where waveform data is read out and stored;

a waveform generator which functions as a plurality of waveform generating sections each of which generates a waveform for emitting a sound by reading out waveform data from a selected storage area of the first memory; and a control processor which determines, when an instruction for sound emission is provided, a combination of a waveform generating section and a storage area to be used for the instructed sound emission, based on a status of reading waveform data from each storage area by each waveform generating section.

(Structural Example 2)

The structure of Structural Example 1, in which the control processor selects a storage area to be used for the instructed sound emission when the instruction for sound emission is provided, based on number of waveform generating sections which have read out waveform data stored in the storage areas.

(Structural Example 3)

The structure of Structural Example 2, in which the control processor selects, as the storage area to be used for the instructed sound emission, a storage area where number of waveform generating sections which have read out waveform data stored in the storage areas is smaller than number of waveform generating sections for other storage areas, when the instruction for sound emission is provided.

(Structural Example 4)

The structure of Structural Example 2, in which the control processor manages the plurality of storage areas and the plurality of waveform generating sections such that the plurality of storage areas and the plurality of waveform generating sections are associated with each other in a one-to-one relation, and in which the control processor selects, as the waveform generating section to be used for the instructed sound emission, a waveform generating section corresponding to a storage area where number of waveform generating sections which have read out waveform data stored in the storage areas is smaller than number of waveform generating sections for other storage areas, when the instruction for sound emission is provided.

(Structural Example 5)

The structure of Structural Example 2, in which the control processor, when the instruction for sound emission is provided, selects a waveform generating section not emitting sound from among the plurality of waveform generating sections, as the waveform generating section to be used for the instructed sound emission.

(Structural Example 6)

The structure of Structural Example 1, further including:

a second memory having stored therein a plurality of waveform data to be transferred to the first memory, in which the control processor, when the instruction for sound emission is provided and waveform data to be used for the instructed sound emission is in the first memory, causes the selected waveform generating section to read out the waveform data stored in the first memory, and in which the control processor, when the waveform data for which the instruction for sound emission has been provided is not in the first memory, transfers the waveform data to be used for the instructed sound emission from the second memory to the determined storage area of the first memory, and then causes the determined waveform generating section to read out the transferred and stored waveform data.

(Structural Example 7)

The structure of Structural Example 6, in which the control processor, when the waveform data to be used for the instructed sound emission is not in a storage area of the first memory associated with the selected waveform generating section and is in a storage area associated with another waveform generating section other than the selected waveform generating section, sets the storage area associated with the other waveform generating section as a link destination of the selected waveform generating section, and causes the selected waveform generating section to directly read out the waveform data stored in the storage area associated with the other waveform generating section so as to emit a sound.

(Structural Example 8)

The structure of Structural Example 6, in which the control processor, when the waveform data to be used for the instructed sound emission is not in a storage area of the first memory associated with the selected waveform generating section and is in a storage area associated with another waveform generating section other than the selected waveform generating section, copies and transfers the waveform data stored in the storage area associated with the other waveform generating section to the storage area associated with the selected waveform generating section, and causes the selected waveform generating section to read out the copied and transferred waveform data so as to emit a sound.

(Structural Example 9)

The structure of Structural Example 6, in which the control processor, when transferring from the second memory to the first memory the waveform data for which the instruction for sound emission has been provided, selects a storage area whose stored waveform data is not being used by any waveform generating section or a storage area where number of waveform generating sections using waveform data is small, from among the plurality of storage areas of the first memory, and causes the transferred waveform data to be stored.

(Structural Example 10)

The structure of Structural Example 6, in which the first memory has a first storage area where waveform data satisfying a predetermined condition is fixedly stored prior to start of a musical performance including the sound emission, and a second storage area where waveform data transferred from the second memory is variably stored.

(Structural Example 11)

The structure of Structural Example 6, in which the first memory is a storage device having a first reading speed and a first storage capacity, and in which the second memory is a storage device having a second reading speed slower than the first reading speed and a second storage capacity larger than the first storage capacity.

While the present invention has been described with reference to the preferred embodiments, it is intended that the invention be not limited by any of the details of the description therein but includes all the embodiments which fall within the scope of the appended claims.

What is claimed is:

1. A musical sound generation device comprising:

a first memory having a plurality of storage areas where waveform data is read out and stored;

a waveform generator which functions as a plurality of waveform generating sections each of which generates a waveform for emitting a sound by reading out waveform data from a selected storage area of the first memory; and a control processor which determines, when an instruction for sound emission is provided, a combination of a waveform generating section and a storage area to be used for the instructed sound emission, based on a status of reading waveform data from each storage area by each waveform generating section, wherein each of the storage areas is configured such that waveform data stored therein can be simultaneously read out by at least one of the plurality of waveform generating sections, and wherein when the instruction for sound emission is provided, the control processor selects, as a storage area to be used for the instructed sound emission, a storage area for which waveform data stored therein is not being read out by any of the plurality of waveform generating sections or a storage area for which a number of the plurality waveform generating sections which are reading out waveform data stored therein is smaller than a number of the plurality of waveform generating sections which are reading out waveform data stored in other ones of the storage areas.

2. The musical sound generation device according to claim 1, wherein the control processor, when the instruction for sound emission is provided, selects a waveform generating section not emitting sound from among the plurality of waveform generating sections, as the waveform generating section to be used for the instructed sound emission.

3. A musical sound generation device comprising:

a first memory having a plurality of storage areas where waveform data is read out and stored;

a waveform generator which functions as a plurality of waveform generating sections each of which generates a waveform for emitting a sound by reading out waveform data from a selected storage area of the first memory; and a control processor which determines, when an instruction for sound emission is provided, a combination of a waveform generating section and a storage area to be used for the instructed sound emission, based on a status of reading waveform data from each storage area by each waveform generating section, wherein the control processor selects a storage area to be used for the instructed sound emission when the instruction for sound emission is provided, based on a number of waveform generating sections which have read out waveform data stored in the storage areas, wherein the control processor manages the plurality of storage areas and the plurality of waveform generating sections such that the plurality of storage areas and the plurality of waveform generating sections are associated with each other in a one-to-one relation, and wherein the control processor selects, as the waveform generating section to be used for the instructed sound emission, a waveform generating section corresponding to a storage area for which a number of waveform generating sections which are reading out waveform data stored therein is smaller than a number of waveform generating sections which are reading out waveform data stored in other ones of the storage areas, when the instruction for sound emission is provided.

4. The musical sound generation device according to claim 1, further comprising:

a second memory having stored therein a plurality of waveform data to be transferred to the first memory, wherein the control processor, when the instruction for sound emission is provided and waveform data to be used for the instructed sound emission is in the first memory, causes the selected waveform generating section to read out the waveform data stored in the first memory, and wherein the control processor, when the waveform data for which the instruction for sound emission has been provided is not in the first memory, transfers the waveform data to be used for the instructed sound emission from the second memory to the determined storage area of the first memory, and then causes the determined waveform generating section to read out the transferred and stored waveform data.

5. A musical sound generation device comprising:

a first memory having a plurality of storage areas where waveform data is read out and stored;

a waveform generator which functions as a plurality of waveform generating sections each of which generates a waveform for emitting a sound by reading out waveform data from a selected storage area of the first memory;

a control processor which determines, when an instruction for sound emission is provided, a combination of a waveform generating section and a storage area to be used for the instructed sound emission, based on a status of reading waveform data from each storage area by each waveform generating section; and a second memory having stored therein a plurality of waveform data to be transferred to the first memory, wherein the control processor, when the instruction for sound emission is provided and waveform data to be used for the instructed sound emission is in the first memory, causes the selected waveform generating section to read out the waveform data stored in the first memory, wherein the control processor, when the waveform data for which the instruction for sound emission has been provided is not in the first memory, transfers the waveform data to be used for the instructed sound emission from the second memory to the determined storage area of the first memory, and then causes the determined waveform generating section to read out the transferred and stored waveform data, and wherein the control processor, when the waveform data to be used for the instructed sound emission is not in a storage area of the first memory associated with the selected waveform generating section and is in a storage area associated with another waveform generating section other than the selected waveform generating section, sets the storage area associated with the other waveform generating section as a link destination of the selected waveform generating section, and causes the selected waveform generating section to directly read out the waveform data stored in the storage area associated with the other waveform generating section so as to emit a sound.

6. A musical sound generation device comprising:

a first memory having a plurality of storage areas where waveform data is read out and stored;

a waveform generator which functions as a plurality of waveform generating sections each of which generates a waveform for emitting a sound by reading out waveform data from a selected storage area of the first memory;

a control processor which determines, when an instruction for sound emission is provided, a combination of a waveform generating section and a storage area to be used for the instructed sound emission, based on a status of reading waveform data from each storage area by each waveform generating section; and a second memory having stored therein a plurality of waveform data to be transferred to the first memory, wherein the control processor, when the instruction for sound emission is provided and waveform data to be used for the instructed sound emission is in the first memory, causes the selected waveform generating section to read out the waveform data stored in the first memory, wherein the control processor, when the waveform data for which the instruction for sound emission has been provided is not in the first memory, transfers the waveform data to be used for the instructed sound emission from the second memory to the determined storage area of the first memory, and then causes the determined waveform generating section to read out the transferred and stored waveform data, and wherein the control processor, when the waveform data to be used for the instructed sound emission is not in a storage area of the first memory associated with the selected waveform generating section and is in a storage area associated with another waveform generating section other than the selected waveform generating section, copies and transfers the waveform data stored in the storage area associated with the other waveform generating section to the storage area associated with the selected waveform generating section, and causes the selected waveform generating section to read out the copied and transferred waveform data so as to emit a sound.

7. The musical sound generation device according to claim 4, wherein the control processor, when transferring from the second memory to the first memory the waveform data for which the instruction for sound emission has been provided, selects a storage area whose stored waveform data is not being used by any waveform generating section or a storage area whose waveform data is being used by a relatively small number of waveform generating sections, from among the plurality of storage areas of the first memory, and causes the transferred waveform data to be stored.

8. The musical sound generation device according to claim 4, wherein the first memory has a first storage area where waveform data satisfying a predetermined condition is fixedly stored prior to start of a musical performance including the sound emission, and a second storage area where waveform data transferred from the second memory is variably stored.

9. The musical sound generation device according to claim 4, wherein the first memory comprises a storage device having a first reading speed and a first storage capacity, and wherein the second memory comprises a storage device having a second reading speed slower than the first reading speed and a second storage capacity larger than the first storage capacity.

10. A musical sound generation method of a musical sound generation device having a waveform generator which functions as a plurality of waveform generating sections each of which generates a waveform for emitting a sound by reading out waveform data from a selected storage area in a first memory having a plurality of storage areas that read out and store waveform data, the method being performed under control of a control processor of the musical sound generation device, and the method comprising:

determining, when an instruction for sound emission is provided, a combination of a waveform generating section and a storage area to be used for the instructed sound emission, based on a status of reading waveform data from each storage area by each waveform generating section, wherein each of the storage areas is configured such that waveform data stored therein can be simultaneously read out by at least one of the plurality of waveform generating sections, and wherein, when the instruction for sound emission is provided, the determining determines, as a storage area to be used for the instructed sound emission, a storage area for which waveform data stored therein is not being read out by any of the plurality of waveform generating sections or a storage area for which a number of the plurality waveform generating sections which are reading out waveform data stored therein is smaller than a number of the plurality of waveform generating sections which are reading out waveform data stored in other ones of the storage areas.

11. A non-transitory computer-readable storage medium having stored thereon a program that is executable by a computer to function as the musical sound generation device according to claim 1.

12. An electronic instrument comprising:

the musical sound generation device according to claim 1;

an input section which specifies waveform data by a musical performance including the sound emission; and an output section which outputs an emitted musical sound.

* * * * *